US008708200B2

(12) United States Patent
Nilsson

(10) Patent No.: US 8,708,200 B2
(45) Date of Patent: Apr. 29, 2014

(54) DISPOSABLE PUMP WITH SUCK-BACK MECHANISM

(75) Inventor: Hugo Nilsson, Ljungby (SE)

(73) Assignee: SCA Hygiene Products AB, Gothenburg (SE)

( * ) Notice: Subject to any disclaimer, the term of this patent is extended or adjusted under 35 U.S.C. 154(b) by 119 days.

(21) Appl. No.: 12/918,063

(22) PCT Filed: Feb. 18, 2008

(86) PCT No.: PCT/SE2008/000130
§ 371 (c)(1),
(2), (4) Date: Aug. 18, 2010

(87) PCT Pub. No.: WO2009/104994
PCT Pub. Date: Aug. 27, 2009

(65) Prior Publication Data

US 2010/0327019 A1 Dec. 30, 2010

(51) Int. Cl.
*B65D 37/00* (2006.01)

(52) U.S. Cl.
USPC ..... 222/207; 222/212; 222/213

(58) Field of Classification Search
USPC ..... 222/207, 571, 212, 517, 209, 213, 449, 222/450, 451, 375, 205, 444–445; 417/478, 417/566
See application file for complete search history.

(56) References Cited

U.S. PATENT DOCUMENTS 1,575,567 A 3/1926 Geake
3,141,580 A * 7/1964 Rogers ..... 222/213
3,715,060 A 2/1973 Benson
3,952,924 A 4/1976 Benson
4,330,071 A 5/1982 Ohlson
4,440,323 A * 4/1984 Benson ..... 222/209
4,991,747 A 2/1991 Van Brocklin
5,083,678 A 1/1992 Waring (Continued)

FOREIGN PATENT DOCUMENTS

DE 90 12 878 U1 1/1991
DE 297 19 331 U1 2/1998

(Continued)

OTHER PUBLICATIONS

Decision on Grant in Russian Application No. 2010138594.

(Continued)

*Primary Examiner* — Kevin P Shaver
*Assistant Examiner* — Robert Nichols, II
(74) *Attorney, Agent, or Firm* — Drinker Biddle & Reath LLP

(57) ABSTRACT

A disposable pump for liquid dispensing includes a chamber in which pressure may be varied for pumping liquid from a compressible container to the chamber to a dispensing opening. The chamber encloses an inner valve that regulates liquid flow between the container and the chamber, and an outer valve regulates flow of liquid between the chamber and the dispensing opening. The pump has a closed position where liquid is drawn from the container to the chamber by negative pressure in the chamber. To dispense, a volume of liquid is drawn from the chamber to the dispensing opening. The inner valve is a one-way valve openable to flow liquid in the dispensing direction when inner valve opening pressure acts in the dispensing direction, and closes for pressure acting in the opposite direction. The outer two-way valve opens to flow liquid in the dispensing or opposite direction.

21 Claims, 13 Drawing Sheets

(56) References Cited

U.S. PATENT DOCUMENTS

| | | | | |
|---|---|---|---|---|
| 5,439,146 | A | 8/1995 | Niss | |
| 5,730,327 | A | 3/1998 | Stern | |
| 5,816,453 | A | 10/1998 | Spencer et al. | |
| 5,842,605 | A | 12/1998 | Lehmkuhl | |
| 6,082,586 | A | 7/2000 | Banks | |
| 6,708,714 | B1 | 3/2004 | Mijers | |
| 6,971,553 | B2 * | 12/2005 | Brennan et al. | 222/207 |
| 2002/0074359 | A1 | 6/2002 | Weber | |
| 2002/0122906 | A1 | 9/2002 | Pellicer et al. | |
| 2002/0139816 | A1 | 10/2002 | Powling | |
| 2004/0069800 | A1 | 4/2004 | Piccinino, Jr. et al. | |
| 2005/0115984 | A1 | 6/2005 | Pritchett et al. | |
| 2006/0124663 | A1 | 6/2006 | Salemme | |
| 2006/0249538 | A1 | 11/2006 | Ophardt et al. | |
| 2008/0029556 | A1 | 2/2008 | Chen | |

FOREIGN PATENT DOCUMENTS

| | | | | |
|---|---|---|---|---|
| DE | 103 00 595 | A1 | 8/2003 | |
| EP | 0 072 783 | A1 | 2/1983 | |
| EP | 0072783 | A1 * | 2/1983 | A47K 5/12 |
| EP | 0 836 824 | A2 | 4/1998 | |
| EP | 0 774 074 | B1 | 2/1999 | |
| EP | 0 956 801 | A2 | 11/1999 | |
| EP | 0 963 729 | A2 | 12/1999 | |
| EP | 0 854 685 | B1 | 2/2000 | |
| EP | 1 215 167 | A2 | 6/2002 | |
| EP | 1 296 811 | B1 | 1/2005 | |
| EP | 1 557 369 | A1 | 7/2005 | |
| EP | 1 629 900 | A2 | 3/2006 | |
| FR | 2 821 583 | A1 | 9/2002 | |
| FR | 2 856 984 | A1 | 1/2005 | |
| GB | 1 270 075 | A | 4/1972 | |
| GB | 2 329 222 | A | 3/1999 | |
| GB | 2 365 510 | A | 2/2002 | |
| RU | 2 116 947 | C1 | 8/1998 | |
| SU | 452330 | A1 | 12/1974 | |
| SU | 1227177 | A1 | 4/1986 | |
| WO | 94/12791 | A1 | 6/1994 | |
| WO | 97/13439 | A1 | 4/1997 | |
| WO | 98/16148 | A1 | 4/1998 | |
| WO | 02/00417 | A1 | 1/2002 | |
| WO | 2005/046415 | A1 | 5/2005 | |

OTHER PUBLICATIONS

International Search Report, dated Nov. 6, 2008, from corresponding PCT application.

Decision on Grant, dated Dec. 29, 2011, from corresponding Russian application.

International Search Report, dated Oct. 27, 2008, from Application PCT/SE2008/000128.

International Search Report, dated Oct. 27, 2008, from Application PCT/SE2008/000129.

Decision of Refusal in Colombia patent application No. 10111948, filed Sep. 9, 2010.

Office Action from the Mexican Institute of Industrial Property in MX Application MX/a/2010/007232, May 6, 2013.

* cited by examiner

DISPOSABLE PUMP WITH SUCK-BACK MECHANISM

TECHNICAL FIELD

The present invention relates to a disposable pump for a dispensing system for liquids, in particular for a dispensing system which comprises a compressible container.

BACKGROUND OF THE INVENTION

This invention relates to the field of disposable suction pumps for dispensing a liquid material, such as soap or alcohol detergent out of a container such as a bottle or the like. A vast number of different suction pumps have been proposed in the past. Generally, many suction pumps include a pressure chamber, from which a volume of liquid may be dispensed. The liquid leaving the chamber creates a negative pressure in the fluid chamber, which negative pressure functions to draw new liquid from the container into the pressure chamber, which thereby is filled and ready to dispense a new volume of liquid.

In use, the container is interconnected to the pump, and introduced in a dispenser, which is typically fixedly arranged on a wall in a bathroom or the like. Certain dispensers include a non-disposable pump which is integrated with the dispenser, and to which disposable containers may be coupled. In contrast, this invention relates to a disposable pump, which may be connected to a disposable container for attachment to a fixed (multiple use) dispenser.

One type of dispensers includes an actuation means for activating the pump and dispensing a volume of fluid. Another type of dispensers is arranged such that a portion of the pump extends out from the dispenser, displaying an actuation means arranged in integrity with the pump. There are generally two kinds of actuation means, whether integrated in the dispenser or in the pump.

One kind is a longitudinally acting actuation means. Longitudinally relates in this context to a direction parallel to the dispensing direction and to a spout of the pump. Pumps for longitudinal actuation often comprise a slidable piston which may be pushed/pulled in a longitudinal direction for diminishing/expanding the volume inside the pressure chamber of the pump, whereby the pumping effect is created. When the actuation means is formed in integrity with the pump it may comprise an outlet for dispensing the liquid.

Another kind of actuation means is a transversely acting actuation means. Transversely relates in this context to a direction transverse to the dispensing direction and to a spout of the pump. Pumps for transversal actuation are typically to be arranged in a fixed dispenser which comprises a transversally acting actuation means. The transversally acting actuation means may be a bar or the like, which upon transversal displacement acts to diminish the volume inside the pressure chamber of the pump.

As the pumps, containers are known in a large variety of forms. One particular type of containers are collapsible containers, which are intended to gradually collapse, decreasing their inner volume, as fluid is dispensed therefrom. Collapsible containers are particularly advantageous in view of hygienic considerations, as the integrity of the container is maintained throughout the emptying process, which ensures that no contaminants are introduced thereto, and that any tampering with the content of the container is impossible without visibly damaging the container. Use of collapsible containers involves particular requirements to the pumps. In particular, the suction force created by the pump must be sufficient not only to dispense the liquid, but also to contract the container. Moreover, a negative pressure may be created in the container, striving to expand the container to its original shape. Hence, the pump must be able to overcome also the negative pressure.

One type of collapsible containers is simple bags, generally formed from some soft plastic material. Bags are generally relatively easy to collapse, and the bag walls would not strive to re-expand after collapse, hence the bag walls would not contribute to the any negative pressure in the bag.

Another type of collapsible containers is known from e.g. EP 0 072 783 A1 and DE 90 12 878 U1. This type of collapsible containers has at least one relatively rigid wall, towards which the collapse of the other, less rigid walls of the container will be directed. Hence, hereinafter, this type of container is referred to as a semi-rigid collapsible container. This type of collapsible containers is advantageous in that information may be printed on the rigid wall, such that the information remains clearly visible and undistorted regardless of the state of collapse of the container. Moreover, for some contents, containers having at least one relatively rigid wall may be preferable over bags. However, collapsible containers having at least one relatively rigid wall may require a greater suction force generated from the pump in order to overcome the negative pressure created in the container during emptying thereof, than the bags.

For disposable pumps, there is a general need that the pump should be relatively easy and economic to manufacture. Moreover, it is advantageous if the pump includes materials that may easily be recycled after disposal and even more advantageous if the pump may be recycled as a single unit without need of separating its parts after disposal.

EP 1 215 167 describes a disposable pump comprising four plastic parts, each being formed by extruding techniques. The first part forms a connector portion being provided with threads, to be screwed onto a bottle. From the connector portion, a spout extends, said spout ending with a perforated plate through which content from the bottle may pass. The first part also forms a stem, extending from the perforated plate. A second part is thread onto the stem, and form two membranes, arranged one after the other, to constitute the valves of the pump. A third extruded part form a pressure chamber, which is connected to the first part so that the stem is introduced into the chamber and the membranes come in sealing contact with the inner walls of the pressure chamber. Finally, a fourth extruded portion made from an elastic material is connected to the outer wall of the pressure chamber, and in fluid contact therewith. The fourth extruded portion form a pressure bulb which, when depressed, increases the pressure in the pressure chamber.

The pump of EP 1 215 167 includes four parts which may be made of similar, however not identical materials. However, the pump of EP 1 215 167 would not be able to generate a suction pressure sufficient to empty a collapsible container, as the negative pressure from the collapsible container would inhibit the pressure bulb from expanding, and hence the function of the pump would be severely impaired if used with a collapsible container.

EP 0 854 685 describes another disposable pump. This pump is formed from two unitary elements both made entirely from plastic so as to be disposable as a unit. The two elements is a chamber forming body and a piston comprising a stem and two one-way valves. The piston is slidably received in the chamber forming body and liquid is drawn from the container by outward and inward movement of the piston in the chamber forming body. In the application, it is explained that if a positive pressure is maintained inside the container to which the pump is attached, the pump will reciprocate, e.g. manually applied forces may be used to move the piston inwardly against the pressure in the container, and the pressure in the container will urge the regulator outwardly in a return stroke.

From the above description, it is understood that if a negative pressure (a negative pressure) is maintained inside the container, as would be the case using a collapsible container, the piston will not be able to automatically return, which means that the feeding of liquid from the pump is relatively complicated.

Hence, none of the above-mentioned pumps are satisfactory for use with a collapsible container. Instead, known pumps that are used for collapsible containers are relatively expensive, including a relatively large number of components and often a great variety of materials.

In view of the above, there is a need for a disposable pump which may easily be recycled, and which is suitable for use with a collapsible container, in particular with a container of the semi-rigid type. Preferably, the pump should be returning such that no outside force must be applied to return the pump to a filled state after dispensing liquid.

Advantageously, the pump should be suitable for pumping liquid materials of different viscosities, from low viscosity material such as alcohol to high viscosity material such as liquid soap.

Preferably, the pump should be possible to activate using transverse activation means.

Preferably, the pump shall be resistant against leakage. Advantageously, the pump shall incorporate a suck-back mechanism to further protect against leakage.

The object of this invention is to provide a pump which fulfils one or more of the above-mentioned requirements.

SUMMARY OF THE INVENTION

This object is achieved by a pump for a dispensing system for liquids, in particular to a dispensing system which comprises a compressible container, wherein the pump comprises a chamber in which the pressure may be varied for pumping liquid from the container to the chamber, and further from the chamber to a dispensing opening, the chamber comprising an inner valve for regulating a flow of liquid between the container and the chamber, and an outer valve for regulating a flow of liquid between the chamber and the dispensing opening, wherein the pump may assume

- a closed position, in which a volume of liquid is drawn from the container to the chamber by means of a negative pressure created in the chamber,
- and a dispensing position, in which a volume of liquid is drawn from the chamber to the dispensing opening;

wherein

- the inner valve is a one-way valve, for opening for a flow of liquid in the dispensing direction at an inner valve opening pressure acting in the dispensing direction, and closing for any pressure acting in a direction opposite to the dispensing direction,
- the outer valve is a two-way valve, for opening for a flow of liquid in the dispensing direction or in the direction opposite the dispensing direction at an outer valve opening pressure, depending on the direction of the outer valve opening pressure,
- such that, as the pump transfers from the dispensing position to the closed position, and a negative pressure is created in the chamber,
- the pressure difference between the container and the chamber will cause the inner valve to open so as to allow liquid to pass from the container to the chamber, and
- the pressure difference between the dispensing opening and the chamber will cause the outer valve to open to allow liquid to be sucked back from the dispensing opening to the chamber.

Generally, a negative pressure is created in the chamber when it is emptied, that is when liquid has just been dispensed from the pump. In this situation, a residue of liquid may remain in the vicinity of the dispensing opening. With the proposed pump, the pressure difference between the dispensing opening and the negative pressure in the chamber, will cause the outer valve to open, and any residue of liquid to be sucked back into the chamber.

Advantageously, the pump is designed such that

- when the pump is in its dispensing position, the outer valve forms said two-way valve, and
- when the pump is in its closed position, the outer valve seals between the chamber and the dispensing opening, such that, as the pump transfers from the dispensing position to the closed position, the outer valve will initially open to allow liquid to be sucked back from the dispensing opening to the chamber, and then, as the closed position is reached, seal between the chamber and the dispensing opening.

In this embodiment, it is ensured that refill of liquid from the container as regulated by the inner valve can dominate over any sucking back of liquid and later of air from the dispensing opening. The chamber generally intended to be refilled with liquid from the container, and not with air from the opening. Hence, it is desired that the outer valve opens to allow suck back of liquid only for a flow being considerably smaller than the flow of liquid from the container as regulated by the inner valve. In accordance with the proposed embodiment, the outer valve may open for a flow in a direction opposite to the dispensing direction only for a brief time period during the pump transfers from the dispensing position to a closed position. The inner valve may however continue to open for a flow in the dispensing direction also when the pump has reached the closed position.

Advantageously, when the pump is in its dispensing position, the outer valve assumes a tilted position in the chamber, and when the pump is in its closed position, the outer valve assumes a symmetrical position in the chamber. In the tilted position, the opening pressure of the outer valve may be less than in the symmetrical position, such that suck-back may take place when the valve is in its tilted position but not when it is in its symmetrical position. During the pumps transition from the dispensing position to the closed position, the outer valve may move from the tilted position to the symmetrical position. This means that the outer valve may initially open to allow for suck back, but finally close as the symmetrical position is reached.

Alternatively or in addition to the above, the inner valve opening pressure may be less than the outer valve opening pressure, such that the outer valve will close before the inner valve as the negative pressure in the chamber is leveled out.

Advantageously, the inner valve, when in a closed position, may have a contact area with the chamber being greater than the contact area of the outer valve, when in a closed position.

Advantageously, the outer valve, when in a closed position in the chamber, is circumferentially compressed in relation to an uncompressed state of the outer valve, and the difference between the diameter of the chamber at the location being in contact with the outer valve when in a closed position, and the diameter of the outer valve when in an uncompressed state, is between 0.09 and 0.20 mm, preferably between 0.10 and 0.20 mm, most preferred between 0.10 and 0.15 mm.

Advantageously, the inner valve, when in a closed position in the chamber, is circumferentially compressed in relation to an uncompressed state of the inner valve and the difference between the diameter of the chamber at the location circumferentially compressing the inner valve and the diameter of the inner valve when in an uncompressed state is between 0.20 and 0.35 mm circumferential direction, preferably between 0.25 and 0.35, most preferred between 0.25 and 0.30. Preferably, the inner valve is a parabolic valve. A parabolic valve is suitable as a one-way valve which may seal tightly in one direction.

Advantageously, the inner valve comprises a rim which is movable to and from sealing contact with the chamber, said rim forming an angle with the longitudinal axis of the pump, wherein the angle is in the range 15-30 degrees, more preferred 20-30 degrees, most preferred 20-25 degrees.

Advantageously, the outer valve may have an outer shape at least partly following the contour of a sphere. A generally spherical shape is advantageous for function as a two-way valve as opening may be accomplished in two opposite directions.

Preferably, the outer shape of the outer valve follows the contour of the sphere for forming at least half a sphere.

Advantageously, the outer valve comprises a rim which is movable to and from a sealing contact with the chamber, and said rim, when the pump is in its closed position, is confined between parallel chamber walls and extending in parallel to said walls.

Further, this application describes a disposable pump for a dispensing system for dispensing liquids, in particular for a dispensing system which comprises a compressible container, wherein the pump comprises

- a housing forming a chamber and a dispensing opening, wherein the pressure in the chamber may be varied for pumping liquid from the container to the chamber, and further from the chamber to a dispensing opening, and
- a regulator being fixedly arranged in the chamber for regulating a flow of liquid between the container and the chamber, and between the chamber and the dispensing opening, the regulator comprising
  - an outer valve for regulating the flow between the chamber and the dispensing opening, wherein the pump may assume

- a closed position, in which a volume of liquid is drawn from the container to the chamber by means of a negative pressure created in the chamber,
- and a dispensing position, in which a volume of liquid is drawn from the chamber to the dispensing opening, wherein the outer valve is displaceable between

- a symmetrical position which corresponds to said closed position of the pump, wherein the outer valve is in sealing contact with the housing, and
- a tilted position which corresponds to said dispensing position of the pump, wherein the outer valve is movable to and from sealing contact with the housing dependent on the pressure variations in the chamber, and
  - the displacement of said outer valve from said symmetrical position to said tilted position requires external force being applied to the pump and transferred to said regulator independent of the pressure variations in the chamber.

In a pump as proposed above, dispensing of liquid will only take place when the outer valve is in its tilted position, and if simultaneously the pressure in the chamber is large enough to open the outer valve. When the outer valve is in its symmetrical position, it is not intended to open for any pressures that may appear in the chamber when the pump is in this position, but will always remain closed.

The displacement of the outer valve from the symmetrical position which is generally closed, to the tilted position where the outer valve may open and close, requires external force other than the pressure in the chamber. Hence, the proposed pump adds an extra requirement for opening and dispensing liquid to the requirement for a sufficient pressure in the chamber which is general in prior art pumps. In the proposed pump, an external force resulting in the outer valve assuming the tilted position is a first requirement for opening of the outer valve, and sufficient pressure in the chamber when the outer valve is in the tilted position is a second requirement for opening of the outer valve.

It is understood that the outer valve may theoretically be openable when in the symmetrical position. However, the outer valve is generally easier to open when in the tilted position. Hereinafter, the term "opening pressure" is used to refer to the pressure difference between the two compartments which are sealed off by the valve at which the valve will open. Hence, a valve having a higher opening pressure is stronger, and opens less easily, than a valve having a lower opening pressure.

The above may be described as the outer valve having a symmetrical position opening pressure when in the symmetrical position, and a tilted position opening pressure when in the tilted position, the tilted position opening pressure being less than the symmetrical position opening pressure.

It is understood that the outer valve, when in a symmetrical position in the chamber, will be symmetrically supported by the chamber walls. This generally results in a relatively large opening pressure. This means that the sealing of the valve in this position is relatively strong, resulting in a pump which will not unintentionally leak.

In the tilted position, the symmetry is broken, and the outer valve will asymmetrically contact the chamber walls when sealing. Such a seal would generally result in a lower opening pressure than the larger opening pressure obtained in the symmetrical position. Hence, in this position, the valve will open more easily so as to allow fluid to pass from the chamber to the dispensing opening.

Accordingly, the symmetric position opening pressure may be selected without regard to the dispensing of fluid, but only with regard to keeping the pump from leaking. Hence, a higher opening pressure may be selected than for prior art pumps where the outer valve have only one position, in which the opening pressure must not be higher than that fluid can still be dispensed therethrough. Hence, in the proposed pump, the pressure in the chamber may be increased quite considerably without the outer valve opening to dispense fluid, unless an external displacement force is applied. Accordingly, unintentional increase of pressure in the chamber, that could result when handling the pump or by temperature differences in the surroundings, will not result in fluid being dispensed from the pump. The proposed pump is very resistant to leakage.

Preferably, the regulator comprises a stem carrying said outer valve, and wherein the stem is resilient along its length so as to bendable, from an original shape, wherein the outer valve assumes its symmetrical position, to a distorted shape, wherein the outer valve assumes its tilted position. Thus, the external force may be applied so as to be transferred to and distort the stem, resulting in the outer valve assuming its tilted position, independent of the present pressure in the chamber.

Preferably, the stem is resilient so as to automatically return to the distorted position after bending, resulting in the valve automatically returning to the symmetrical position from the tilted position. As such, removal of the external force will automatically result in the return of the pump to a closed position.

Advantageously, the chamber is resilient so as to be compressible around the regulator, so that an external force compressing the chamber will transfer to the regulator causing the outer valve to assume the tilted position. In this case, the compression of the chamber will transfer an external force to the regulator for displacing the outer valve to the tilted position, and simultaneously increase the pressure in the chamber.

The above situation is not to be excluded by the phrase "independent of the pressure in the chamber" as used above. It is understood that also in this case, the displacement of the outer valve is not caused by the increased pressure in the chamber, but by action of the chamber walls being displaced towards the regulator.

In embodiments where the regulator includes a bendable stem as described above, it is understood that the displacement of the outer valve to the tilted position takes place in a direction opposite to the direction in which the increased pressure in the chamber acts to displace the outer valve.

However, since the compression of the chamber will result in tilting of the outer valve and a simultaneous increase of the pressure of the liquid contained in the chamber, it is understood that the pump will dispense liquid as a result of the compression. The transition of the pump to the dispensing position is caused by the displacement of the valve, and the opening of the outer valve when in the dispensing position is caused by the increased pressure in the chamber.

In order to further promote the differences in opening pressure between the symmetrical and the tilted position, the outer valve may advantageously be resilient and have a first flexibility across a first cross-section, which cross-section is in contact with the chamber when the outer valve is in the symmetrical position, and a second flexibility across a second cross-section, which second cross-section is in contact with the chamber when the outer valve is in the tilted position, the second flexibility being greater than the first flexibility resulting in said tilted position opening pressure being less than said symmetrical position opening pressure.

In this manner, the flexibility of the outer valve may be used to accomplish the different opening pressures, or to enhance the different pressures as already described which are caused by the different locations of support from the chamber walls to the outer valve. The flexibility may be controlled by varying the amount of material in different cross-sections of the valve.

Advantageously, the outer valve has an outer shape at least partly following the contour of a sphere, such that a first and a second circular cross section having the same radius may be defined, corresponding to said symmetrical and tilted positions, respectively.

Moreover a partly spherical valve has the advantage that it may be tightly pressed into a chamber allowing for a relatively large surface contact between the valve and the chamber. This is particularly the case if the sphere and/or the chamber are made of resilient material. A relatively large surface contact allows for relatively large opening pressures of the valve.

Preferably, the peripheries of the first and the second cross-sections have the same size and shape. Hence, sealing contact with a chamber having unitary cross-section at the location of the valve may be ensured both in the symmetrical and in the tilted position.

Advantageously, the maximum tilted position may be about 10-45° from the symmetrical position, preferably about 20-30°.

It should be understood that the tilted position is not a completely "open" position, i.e. the outer valve is not tilted so as to open. Instead, the tilted position is a position in which the valve works as a pressure valve, opening and closing depending on the surrounding pressures.

To ensure that the outer valve does not open too much, i.e. to an extent wherein a sealing contact with the chamber is no longer possible, a spacer may be provided to inhibit the valve from tilting past a maximum tilt position.

In the case when the regulator comprises a bendable stem, the spacer may advantageously be provided on the stem for restricting the bending movement of the stem. When the regulator distorts, the spacer will eventually contact the chamber walls, hence inhibiting further distortion of the regulator and setting a limit also for the tilting of the outer valve.

Preferably, the pump consists of two parts only, said housing and said regulator. Naturally, a pump according to the above may be accomplished using any number of parts. However, it is believed to be highly advantageous that the numerous benefits as explained above may be accomplished using only two pump parts, a housing and a regulator.

Moreover, this application describes a dispensing system comprising

- a collapsible container for liquid material and
- a pump being sealingly connected to the collapsible container for withdrawal of liquid material from the container during collapse thereof,
- the pump comprising
  - a housing forming a chamber and a dispensing opening, wherein the pressure in the chamber may be varied for pumping liquid from the container to the chamber, and further from the chamber to a dispensing opening,
  - and a regulator being fixedly arranged in the chamber for regulating a flow of liquid between the container and the chamber, and between the chamber and the dispensing opening,
  - wherein the pump may assume a closed position, in which a volume of liquid is drawn from the container to the chamber by means of a negative pressure created in the chamber,
  - and a dispensing position, in which a volume of liquid is drawn from the chamber to the dispensing opening, wherein the pump consists of plastic materials;

and the pump comprises

- return means automatically returning the pump from said dispensing position to said closed position, whereby the return means uses the resiliency of said plastic material for overcoming a negative pressure created in the collapsible container during emptying thereof.

Hence, in accordance with the invention, the resiliency of the plastic material of the pump per se is used to accomplish the return of the pump from a dispensing position to a refill position. This solution is a considerable advantage over prior art systems, as it allows for a returning pump to be formed from plastic material only.

Preferably, the return means have an original shape corresponding to the closed position, and a distorted shape corresponding to the dispensing position, the return means being resilient so as to be movable from the original shape to the distorted shape by an external force applied to the pump, and automatically reassuming their original shape when said external force is removed.

It has not previously been realised, that plastic material resiliency could be sufficient to overcome the negative pressure created in a collapsible container during emptying thereof.

Advantageously, the pump consists of a one-piece housing and a one-piece regulator, hence of only two parts. The use of few parts is advantageous in view of economics for manufacturing and assembling the parts, and contributes to the robustness of the pump.

The plastic materials in the pump need not be identical, but should preferably be of the same type, such that the pump may be recycled as a single unit. Moreover, the compressible bottle should preferably be of the plastic material type as the pump, such that the entire system may be recycled as a single unit. This is particularly advantageous since in this case the persons taking care of the emptied systems may avoid any mess caused by liquid rests from the container or the pump leaking out. As will be understood from the following description of detailed embodiments, the suggested system may be designed such that the pump maintains a sealed condition even when the bottle is emptied. Such embodiments will of course be particularly easy to handle after use.

Advantageously, the container is a semi-rigid collapsible container. By semi-rigid is meant a container as mentioned in the introduction, which has at least one relatively rigid portion, towards which the collapse of the other, less rigid portions will be directed. This type of collapsible containers is advantageous in that information may be printed on the rigid portion, the information being clearly visible and undistorted regardless of the state of collapse of the container. Moreover, for some contents, containers having at least one relatively rigid wall may be preferable over bags. However, collapsible containers having at least one relatively rigid wall may require a greater suction force generated from the pump in order to overcome the negative pressure created in the container during emptying thereof, than the bags. A particular advantage with the proposed system is that it may be made efficient to overcome the relatively large negative pressure generated also by semi-rigid collapsible containers.

Most preferred, the system comprises a container having one rigid longitudinal half and one compressible longitudinal half such that, during emptying, the compressible longitudinal half will conform to the compressible longitudinal half. This type of container is suitable for introduction in many existing dispensing systems while fulfilling the requirements for visibility of information printed on the container. Moreover, the particular shape with one half being compressible into the other ensures that emptied containers require particularly little space.

Advantageously, the chamber is resilient so as to be compressible, from an original shape corresponding to the system being in the closed position, to a compressed, distorted shape, corresponding to the system being in the dispensing position, and the chamber automatically returning to the original shape after compression, whereby the chamber forms part of said return means. It is understood, that by this arrangement, when the external force compressing the chamber is released, the chamber strives to resume its original shape. The return to the original shape means implies that the chamber is expanding, which creates a negative pressure in the chamber. The negative pressure thus created will be efficient for refilling the chamber.

Advantageously, the chamber is generally cylindrical.

Advantageously, the regulator is resilient along its length so as to be bendable upon application of an external force to the pump, from an original shape, corresponding to the system being in the closed position, to a distorted shape, corresponding to the system being in the dispensing position, and the regulator automatically returning to the original shape when the external force is removed, whereby the regulator form part of said return means. When the external force causing the regulator to distort is removed, the regulator will strive to return to the original position, corresponding to the closed position of the pump.

Advantageously, the regulator is arranged inside the chamber such that an external force compressing the chamber will simultaneously result in bending of the regulator, setting the pump in the dispensing position, and when the external force is removed, the chamber and the regulator will both automatically return to their original shapes, setting the pump in the closed position. This setup is particularly suitable as it allows for practical embodiments being relatively tight against leakage.

Preferably, the regulator comprises a stem and at least one valve, wherein the regulator is resilient along the length of the stem.

Advantageously, the regulator comprises a stem and an outer valve, the outer valve being arranged to regulate a flow of liquid between the chamber and the dispensing opening when the regulator assumes its original shape, the outer valve is in a symmetrical position in the chamber, corresponding to a closed position of the pump when the regulator assumes its distorted shape, the outer valve is in a tilted position in the chamber, corresponding to a dispensing position of the pump.

In this embodiment, the resiliency of the regulator is used to displace the outer valve such that the valve has a symmetrical position in the chamber when the pump is in the closed position, and a tilted position in the chamber when the pump is in the dispensing position.

BRIEF DESCRIPTION OF THE DRAWINGS

The invention will be further described by way of an exemplary embodiment with reference to the accompanying drawings in which.

The same reference numbers are used to denote the same features in all of the drawings.

DETAILED DESCRIPTION OF PREFERRED EMBODIMENTS

Figure 1A:
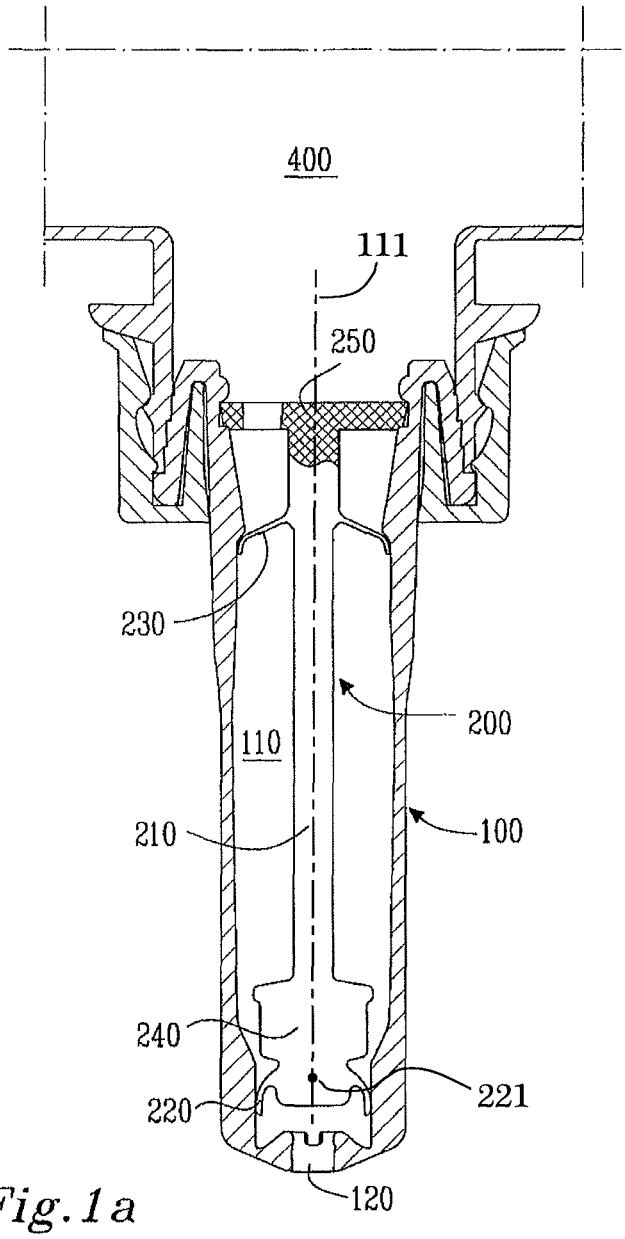
FIGS. 1*a* to 1*d* illustrate schematically a dispensing/refill cycle of an embodiment of a pump in accordance with the invention.

FIGS. 1*a* to 1*d* schematically illustrate one dispensing-refill cycle of an embodiment of a pump 1 in accordance with the invention. For simplicity, FIGS. 1*a* to 1*d* have been stripped from some of the features being dispensable when explaining the general functions of the pump. Instead, detailed features of the illustrated embodiment are explained in relation to the other figures and in connection with additional advantages of the invention.

When in use, the pump 1 is to be sealingly connected to a container containing liquid material such as liquid soap or alcohol detergent. The container is schematically denoted 400 in FIGS. 1*a* to 1*d*. The pump 1 comprises a housing 100 and a regulator 200 being fixedly arranged in the housing 100. The housing 100 forms a chamber 110 in which, as will be described later, the pressure may be varied for dispensing liquid from the pump 1 or refilling liquid from the compressible container 400. Moreover, the housing 100 forms a dispensing opening 120 through which said liquid may be dispensed.

The regulator 200 is fixedly arranged in the chamber 110 for regulating a flow of liquid between the container 400 and the chamber 110, and between the chamber 110 and the dispensing opening. In the illustrated embodiment, the regulator 200 comprises an outer valve 220, which as illustrated in FIG. 1*a* is in sealing contact with the chamber 110, and which regulates the flow of liquid between the dispensing opening 120 and the chamber 110.

The regulator also comprises an inner valve 230, which as illustrated in FIG. 1*a* is also in sealing contact with the chamber 110, and which regulates the flow of liquid between the collapsible container 400 and the chamber 110. Further, the regulator 200 may advantageously comprise fixing means for accomplishing the fixation of the regulator 200 in the chamber 110. In this embodiment, the fixing means comprises a fixation plate 250.

In this application, the term "inner" or "inside" is generally used for a upstream direction, towards the container and opposite to the dispensing direction, whereas the term "outer" or "outside" is generally used for a downstream direction, towards the outlet and in the dispensing direction.

The Dispensing Position

FIG. 1*a* illustrates the pump when in a closed position. In this application, the term "closed position" is used for a position in which no flow occurs between the chamber 110 and the outlet 120. In FIG. 1*a* the pump is in a closed position which is also a storage position in which no flows take place in the system. That is, the regulator 200 controls the flows such that no flow of liquid occurs between the container 400 and the chamber 110 or the chamber 110 and the outlet 120. In the illustrated embodiment, the outer valve 220 and the inner valve 230 are both closed and in sealing contact with the chamber 110 (i.e. with the inner walls of the chamber 110). When in use, the chamber 110 will be full with liquid when the pump is in the storage position.

Figure 1B:
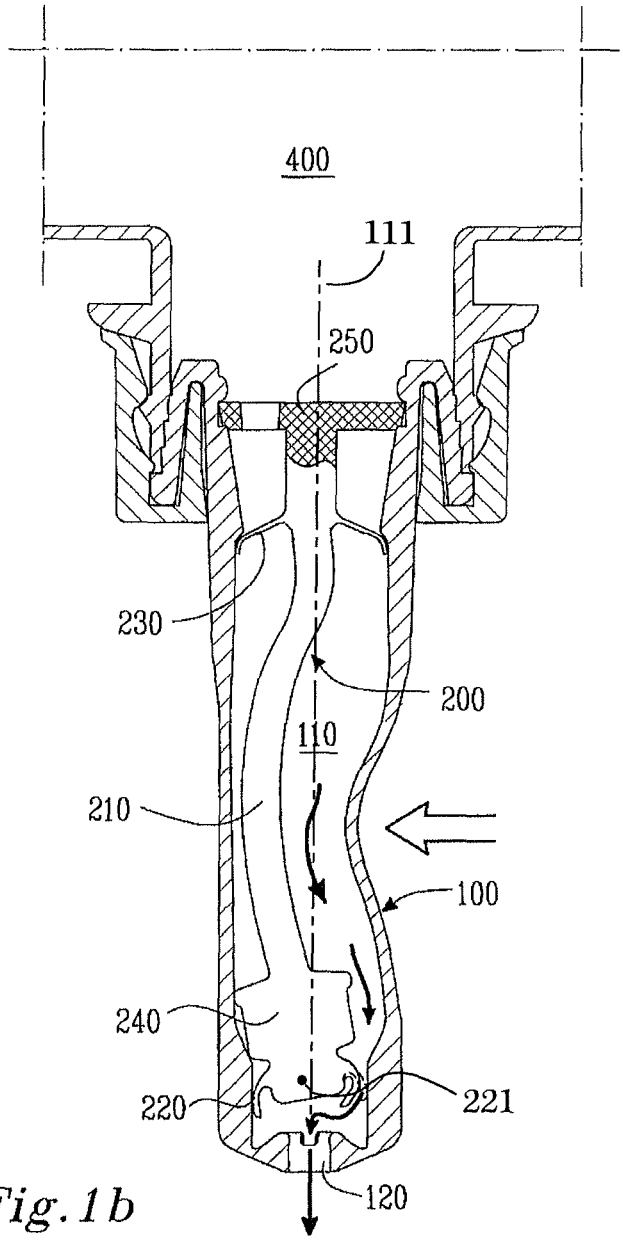

FIG. 1*b* illustrates the pump when in a dispensing position. In this application, the term "dispensing position" is used for a position in which a volume of liquid may be drawn from the chamber 110 to the dispensing opening 120. In the dispensing position, the outer valve 220 is brought to a tilted position by the action of an external force being transferred to the regulator 200.

The outer valve opening pressure in the tilted position is less than the outer valve opening pressure in the original, symmetrical position, i.e. the outer valve opens more easily when in the tilted position as compared to the symmetrical position. This may be explained by the outer valve 220, when in the symmetrical position, being symmetrically supported around its periphery by the chamber 110 walls. This increases the resistance of the valve against compression. In the tilted position, this symmetry is broken. On one side of the outer valve 220, the chamber wall will be in contact with the valve 220 at a position closer to its centre 221 than in the symmetrical position, and on the other side of the outer valve 220, the chamber wall will be in contact at a position further away from the centre 221 of the valve than in the symmetrical position, as shown relative to a longitudinal axis 111 of the chamber 110. Hence, the "locking" effect achieved by symmetrical forces is no longer present, which means that the tilted position opening pressure is less than the symmetrical position opening pressure.

Moreover, in the illustrated embodiment, the outer valve 220 is shaped such that its flexibility across the section of the valve 220 coming in sealing contact with the chamber 110 wall in the symmetrical position (FIG. 1*a*) is less than the flexibility across the section of the valve coming in sealing contact with the chamber 110 wall in the tilted position (FIG. 101*b*). When the flexibility of the effective sealing contact portion of the outer valve 220 is increased, the opening pressure will be reduced. A more detailed description of this embodiment of an outer valve 220 will follow later on in this application.

It is understood, that in the symmetrical position, corresponding to the closed position of the pump, the opening pressure of the outer valve 220 may be selected such that it may withstand a certain pressure increase in the chamber 110 without opening. Only if the outer valve 220 is tilted, which requires application of an external force to the pump, the outer valve 220 may open to allow liquid to be dispensed from the chamber 110.

The outer valve 220 is intended to function as a pressure-controlled valve also when in the tilted position. In other words, the outer valve 220 shall not be tilted so as to be partly removed from the wall of the chamber 110 and hence to open by means of the tilting only. Instead, if there is no or only a small pressure difference between the chamber and the dispensing opening, the outer valve 220 is to seal between the same, also when it is in its tilted position.

In the illustrated embodiment, the chamber 110 is resilient so as to be compressible when exerted to an outer force, as illustrated by the arrow in FIG. 1*b*. The compression of the chamber 110 will cause the pressure in the liquid contained therein to increase.

Moreover, in the illustrated embodiment, the regulator 200 is resilient along its length, so as to be bendable from a neutral position as illustrated in FIG. 1*a*, to a bent position as illustrated in FIG. 1*b*. When the regulator is in its bent position, the outer valve 220 assumes a tilted position in the chamber 110.

In the illustrated embodiment, the regulator 200 comprises a spacer 240 for ensuring that the outer valve 220 will not be tilted too far. The spacer 240 is provided on the stem inside of the outer valve 220, and will contact the inner wall of the chamber 110 during bending of the stem. As such, it limits the bending of the stem and inhibits the outer valve 220 from tilting past a maximum tilt position.

The illustrated embodiment is particularly advantageous in that the external force executes both the compression of the chamber 110, resulting in increased pressure in the chamber 110, and the bending of the regulator 200, resulting in a diminished opening pressure of the outer valve 220, which cooperate to open the outer valve 220 such that liquid will be pressed out from the chamber 110 towards the dispensing opening 120.

Moreover, the external force compressing the chamber 110 will simultaneously result in bending of the regulator 200, setting the pump in the dispensing position.

In the above, the general principle of a pump having an outer valve being displaceable from a closed position to a dispensing position has been described with reference to FIGS. 1*a* and 1*b*. It is to be understood that other embodiments may be envisaged that would use this general principle. For example, although less advantageous, one could imagine using a regulator 200, only a portion of which would be made resilient, or a regulator 200 consisting of a number of parts of which only one is resilient to accomplish the displacement of the outer valve. Also, if using a rigid chamber 110, some other means such as a separate piston could be used to displace the outer valve, and optionally also to increase the pressure in the chamber.

Automatic Return Mechanism

Figure 1C:
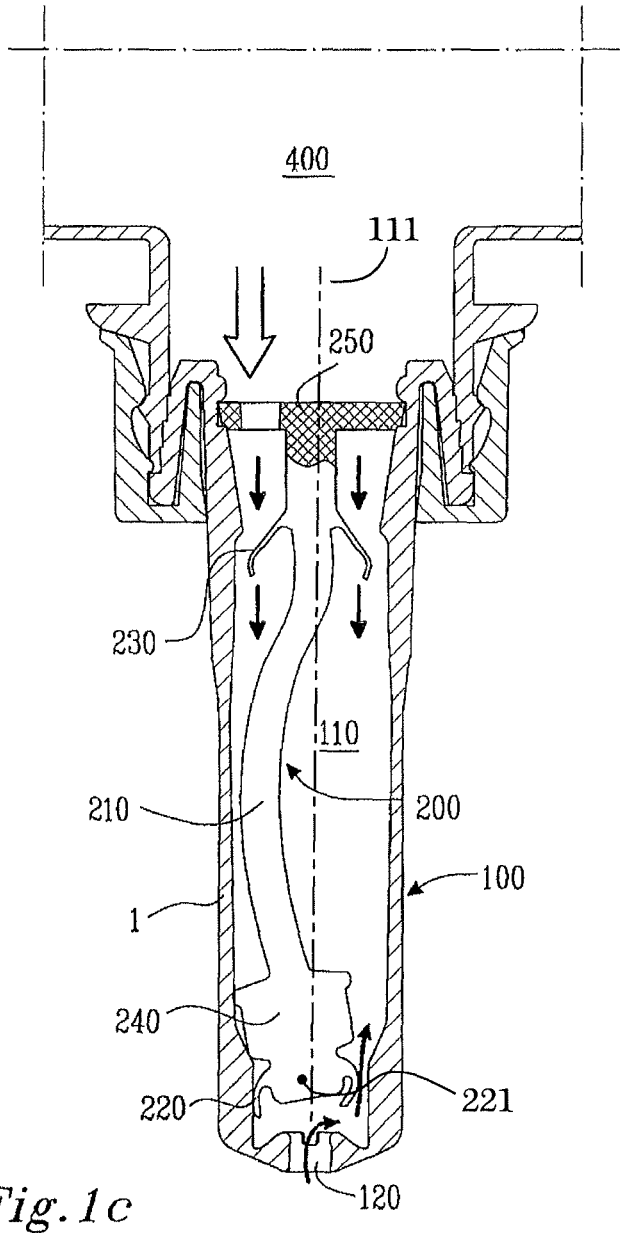
Figure 1D:
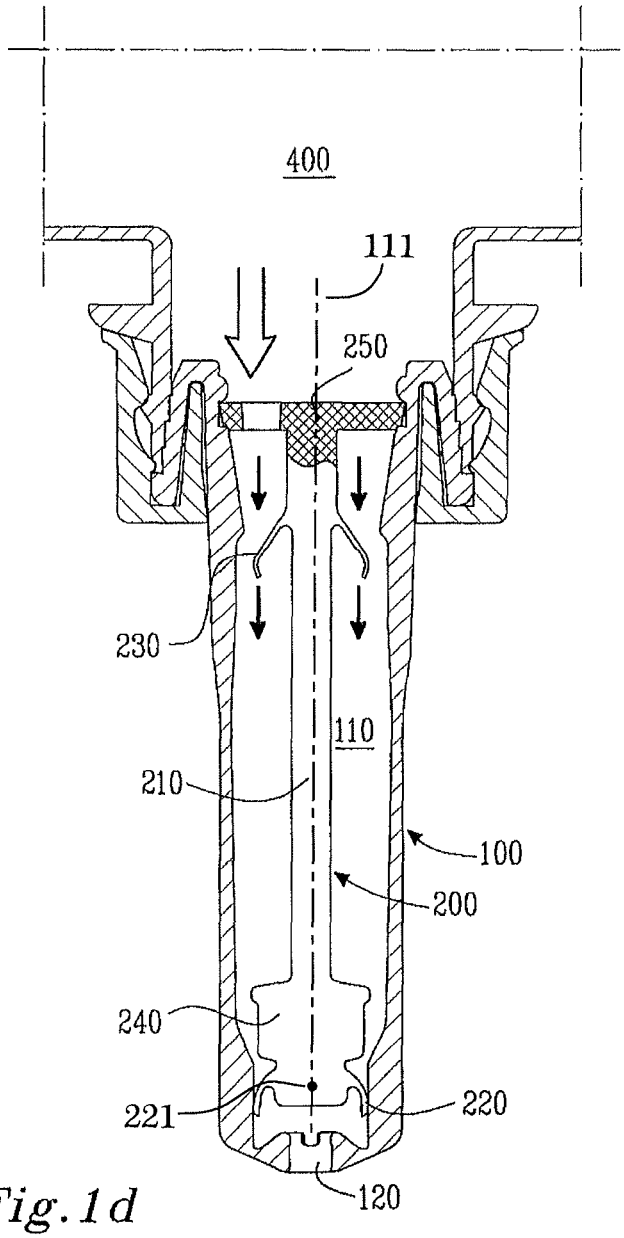

The description of the illustrated embodiment will now continue with particular reference to the FIGS. 1*b* and 1*d*.

In the illustrated embodiment the chamber 110 and the regulator 200 are both formed from resilient materials, preferably plastic materials. In the dispensing position as illustrated in FIG. 1*b*, both the chamber 110 and the regulator 200 are distorted from their original shapes as seen in FIG. 1*a*. When the mechanical impact is removed, the chamber 110 and the regulator 200 will both automatically return to their original shapes, and hence return to a closed position as illustrated e.g. in FIG. 1*d*.

After dispense of liquid, when the external force is removed, the chamber 110 reassumes its original shape and hence expands. The regulator 200 reassumes its original shape resulting in the outer valve 220 reassuming its symmetrical shape, closing the chamber 110. The expansion of the chamber 110 creates a negative pressure in the chamber 110, which will cause the inner valve 230 to open, as illustrated in FIG. 1*d*. Liquid will hence be drawn from the container 400 to the chamber 110 to fill the chamber 110. Once the chamber is refilled, there is no negative pressure in the chamber 110, and the inner valve 230 will close again, returning the pump to the original position of FIG. 1*a*.

In the above, and in the following description, it is to be understood that the pump being in a closed position refers to the pump being closed such that no liquid may pass through the dispensing opening 120. The outer valve 220 is in its closed, symmetrical position. However, in the closed position, the inner valve 230 may open to refill the chamber 110 with liquid from the container. Hence, FIG. 1*d* illustrates a closed position of the pump which is also a refill position.

In the illustrated embodiment, the automatic return of the pump 1 from the dispensing position to the closed position is accomplished by the regulator 200 and the chamber 110 both reassuming their original shapes after distortion thereof. Hence, in this embodiment, both the regulator 200 and the chamber 110 form return means formed by the material of the pump parts.

Hence, in the above, the general principle of a pump having return means formed by resilient plastic material of the pump and using said resiliency to cause automatic return of the pump has been described with reference to FIGS. 1*a* and 1*d*. Moreover, the return means are sufficient to overcome the negative pressure created in a collapsible container. It is to be understood that other embodiments may be envisaged that would use this general principle. For example, although it is believed to be less advantageous, one could imagine that only one of the regulator part or the chamber part form the return means. Also, the return function need not necessarily be combined with a tiltable outer valve (although this is believed to be particularly advantageous).

Suck-Back Mechanism

The above description of the illustrated embodiment, referring only to FIGS. 1*a*, 1*b* and 1*d*, describes per se a possible dispensing-refilling cycle of the pump. This description is however somewhat simplified. In the following the general principle of a suck-back mechanism for a pump for a dispensing system for liquids will now be described with particular reference to FIG. 1*c*.

The illustrated embodiment, which has been used to illustrate the principle of a pump above, is suitable also for the presentation of the general principle of the suck-back mechanism. However, it will be understood that the suck-back mechanism may also be used in other contexts than in this particular embodiment.

The suck-back mechanism relies on the provision of an inner valve 230 being a one-way valve, for opening for a flow of liquid in the dispensing direction at an inner valve opening pressure acting in the dispensing direction, and close for any pressure acting in a direction opposite to the dispensing direction; and of an outer valve 220 being a two-way valve, for opening for a flow of liquid in the dispensing direction or in the direction opposite the dispensing direction at an outer valve opening pressure, depending on the direction of the outer valve opening pressure.

In the illustrated embodiment, the inner valve 230 is a generally parabolic valve cooperating with a seat 130 formed from the inner wall of the housing 100. The seat 130 is located upstream of the inner valve 230, such that the inner valve 230 will function as a one-way valve, opening in the dispensing direction.

In the illustrated embodiment, the outer valve 220 is a partly sphere-shaped valve, cooperating with the inner walls of the housing 100. When in its tilted position, the outer valve 220 will function as a two-way valve, opening for a flow in the direction of a pressure gradient between the chamber 110 and the dispensing opening 120.

When the pump is in the dispensing position as illustrated in FIG. 1*b*, the pressure in the chamber 110 is greater than the pressure at the dispensing opening 120, and the outer valve 220 will open for a flow of liquid from the chamber 110 to the opening 120.

When liquid has been dispensed from the chamber 110, the pump will transfer from a dispensing position FIG. 1*b* to a closed position FIG. 1*d*, in which the outer valve 220 will return to its symmetrical position and a negative pressure be created in the chamber 110.

However, the two-way valve property of the outer valve 220 becomes useful during a brief transitional period in which the pump transfers from the dispensing position (FIG. 1*b*) to the closed position (FIG. 1*d*), as illustrated in FIG. 1*c*. As the external pressure on the chamber is released, a negative pressure will immediately result in the chamber 110. However, the return of the outer valve 220 from its tilted to its symmetrical position is not as fast as the setting in of the negative pressure. Hence, for a brief time period, the outer valve 220 remains in a tilted position, and there is simultaneously a negative pressure in the chamber 110.

The negative pressure in the chamber 110 will cause the outer valve 220 to open to let remaining liquid and/or air from the dispensing opening pass into the chamber 110. Simultaneously, the inner valve 230 will open to let liquid from the container 400 pass into the chamber 110. Hence, as illustrated by the arrows in FIG. 1*c*, in this situation there is one flow of liquid in the dispensing direction into the chamber 110 via the inner valve 230, and one flow of liquid and/or air opposite to the dispensing direction into the chamber 110 via the outer valve 220.

However, the outer valve 220 will eventually resume its symmetrical position as illustrated in FIG. 1*d*. In this position, the opening pressure of the outer valve is greater than in the tilted position, and the valve will no longer open for the flow opposite to the dispensing direction. In contrast, the inner valve 230 remains open until the chamber 110 is refilled with liquid.

Hence, any liquid remaining in the dispensing opening 120 of the housing 100 after the dispensing position may be sucked back into the chamber 110 as the pump transfers from its dispensing position to its closed position. The sucking back should be of a limited extent, as it is of course desired that the chamber is filled with liquid from the container 400 rather than with air via the dispensing opening 120. In accordance with the presented suck-back principle, this is achieved in that the sucking back takes place only during the transfer of the pump from its dispensing position to its closed position, and that the major part of the refill of the chamber 110 is performed in the closed position.

Moreover, the inner valve opening pressure should advantageously be less than the outer valve opening pressure, such that the outer valve will close before the inner valve as the negative pressure in the chamber is leveled out.

In the above, the general principle of a suck-back mechanism using a two-way outer valve and a one-way inner valve has been described with reference to FIG. 1*c*. However, although less advantageous than the illustrated embodiment, it is believed that other embodiments could be conceived using this general principle. For example, other types of one-way and two-way valves may be envisaged. Moreover, it is believed that the suck-back mechanism need not necessarily be combined with the automatic return means of resilient materials but could be present also in embodiments where an external force is needed to return the system to a closed position.

From the above, at least three general principles may be distinguished. First, there is the displacement of the outer valve between a symmetrical position and a tilted position, which occurs when the pump transfers from the closed position to a dispensing position. This feature allows inter alia for pump constructions being free from leakage problems. Second, there is the automatic return of the pump to a closed position from a dispensing position, wherein the resiliency of plastic materials in the pump is used. This feature allows for particularly simple and recyclable constructions which are nevertheless strong to overcome the negative pressure created in a collapsible container. Third, there is the suck-back mechanism, which uses a one-way inner valve and a two-way outer valve and comes into action during the transfer of the pump from a dispensing position to a closed position.

It is understood, that the illustrated embodiment is particularly advantageous as it combines all three general principles in simple construction. Nevertheless, it is believed that the three principles could be used separately, if only one of the particular advantages associated thereto is desired.

Further Advantageous Features

In the following, further advantageous features of the illustrated embodiment will be described.

The Regulator

Figure 2A:
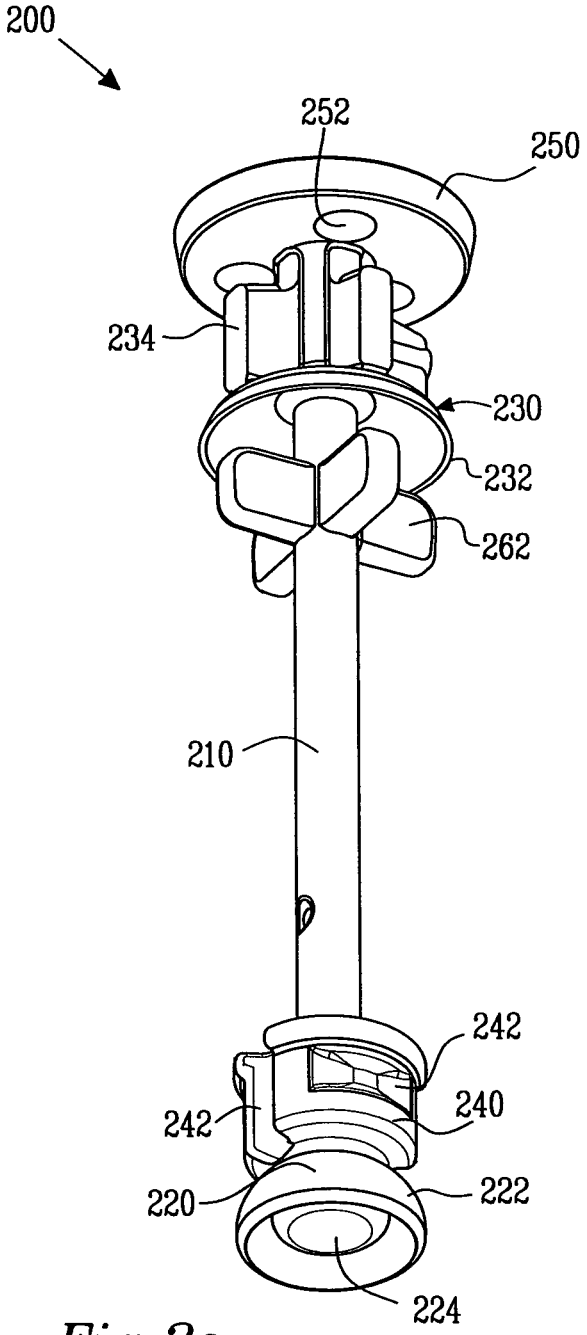
FIGS. 2*a* to 2*c* illustrate a regulator of the embodiment of FIG. 1.
Figure 2B:
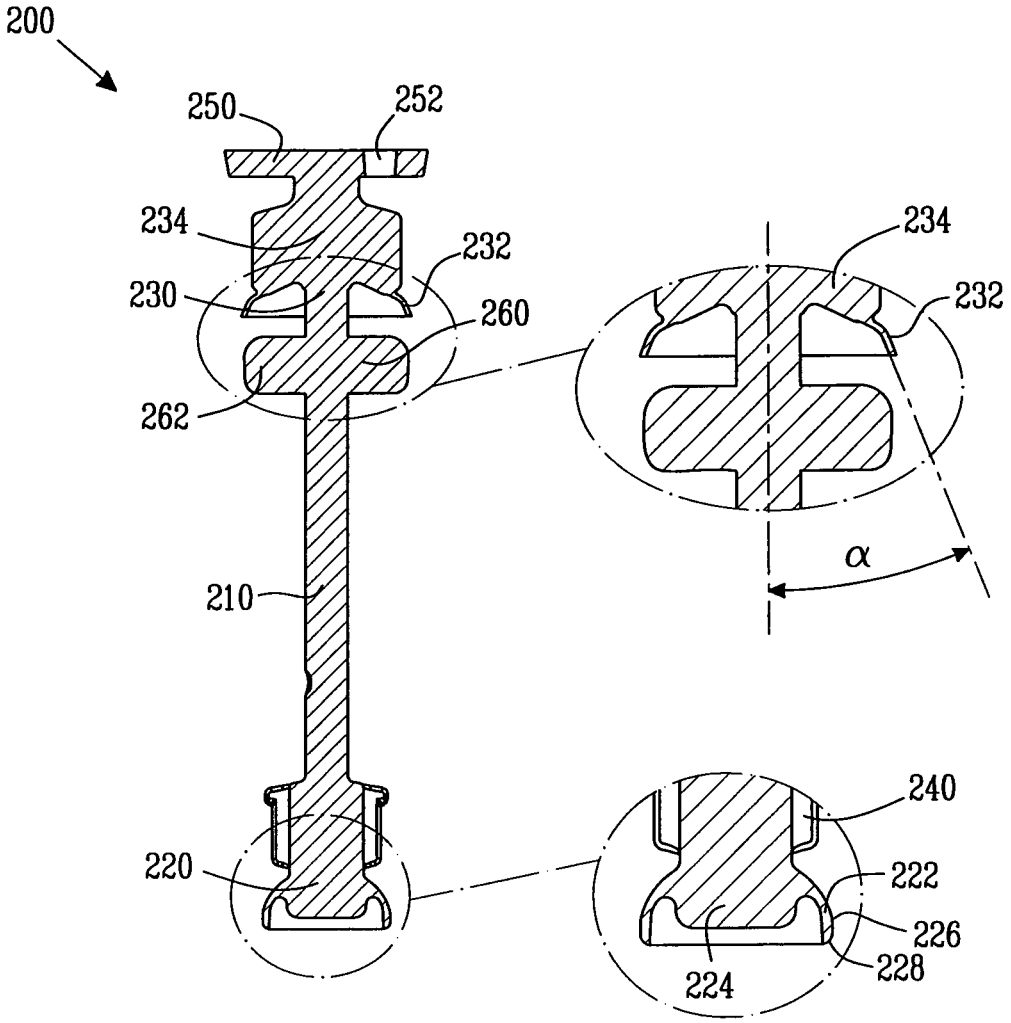
Figure 2C:
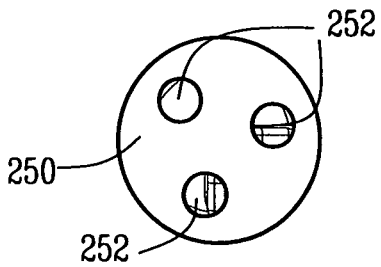

FIGS. 2*a* to 2*c* illustrate a regulator for the illustrated embodiment. FIG. 2*a* is a perspective view of the regulator, FIG. 2*b* is a cross-sectional view of the regulator, and FIG. 2*c* is view of the regulator as seen from the innermost end.

The Outer Valve

As seen in FIGS. 2*a* and 2*b*, the outer valve 220 has an outer shape partly following the contour of a sphere. As is best seen in the enlargement A of FIG. 2*b*, the sphere extends from an attachment portion to the stem along a curve forming a rim 222.

The rim 222 is flexible towards the centre of the valve 220, and resilient so as to resume its original shape after flexing. The flexibility of the rim 222 is advantageously ensured by the rim having a substantially constant thickness. In the centre of the outer valve 220, surrounded by the rim 222, there is a knob 224. The knob 224 and the stem material will contribute to the rigidity of the valve 220. Moreover, the knob 224 is particularly useful when the pump is used to pump high viscosity fluids, which will be described later.

In the enlargement A, it is seen how the rim 222 forms a straight portion 226 right before finishing with relatively short end portion 228, which is curved inwardly towards the centre of the valve 220. Nevertheless, this is understood to be a shape generally (though not necessary exactly) following the outer contour of a sphere. The expression "spherical" is in this context to be seen as in contrast to e.g. a conical or parabolic valve shape.

It is understood, that when the outer valve 220 is in its symmetrical position in the chamber 110, the straight portion will be in contact with the housing walls. However, one could imagine an embodiment where the straight portion 226 is replaced by a portion continuing to follow an exact spherical contour. Also such a portion may be in contact with the chamber walls when in the symmetrical position, but will however presumably be straightened out somewhat by the action of the chamber walls.

It is believed to be advantageous if the contour of the outer valve form a surface portion that may rest in parallel to parallel inner surfaces of the chamber 110. With this construction, the outer valve surface portion may be fitted into the chamber 110 such that the walls thereof exert a symmetrical pressure onto the valve surface portion. The fit between the outer valve 220 and the chamber 110 may be selected so as to achieve a relatively tight opening pressure when the outer valve 220 is in its symmetrical position, where the pressure between the parallel chamber walls and the parallel surface portions will contribute to the opening pressure of the outer valve.

The inward curve portion 228 of the illustrated outer valve 220 is useful to facilitate the motion between the tilted position and the symmetrical position of the valve 220.

Moreover, it contributes to the suck-back function as it provides a surface against which the pressure at the dispensing opening of the valve may act in order to open the outer valve in a direction opposite to the dispensing direction of the pump.

It is understood that the outer valve 220, when positioned in the chamber 110, is circumferentially compressed so as to accomplish the sealing function. Hence, in a relaxed, uncompressed state, the outer valve 220 has an outer diameter being greater than the diameter of the chamber 110 at the location of the outer valve 220. As may be gleaned from FIG. 5*b*, in the illustrated embodiment, the outer valve 220 will be located in an outer compartment 112 of the chamber.

Advantageously, the difference between the inner diameter of the chamber at the location of the outer valve 220, and the outer diameter of the outer valve 220 when in an uncompressed state is between 0.09 and 0.20 mm, preferably between 0.10 and 0.20 mm, most preferred between 0.10 and 0.15 mm.

In the illustrated embodiment, the difference between the inner diameter of the chamber at the location of the outer valve 220, and the outer diameter of the outer valve 220 when in an uncompressed state is about 0.15 mm.

The Spacer

Next to the outer valve 220, there is provided a spacer 240, which functions for controlling the tilting of the outer valve 220 has been described previously. The outer shape of the spacer 240 may easily be determined in relation to the outer valve 220 and the shape of the chamber 110 so as to perform its function. In the illustrated embodiment, the spacer 240 is provided with indentations 242, some longitudinal, some transversal. The indentations 242 facilitate passage of liquid past the spacer 240. Also this feature is particularly useful when the pump is used to pump high viscosity fluids, as will be described later.

The Stem

The stem 210 extends generally between the inner valve 230 and the outer valve 220. The stem is resilient so as to be bendable and is capable of resuming its original shape after bending. The length and diameter of the stem 210 may be selected taking these considerations into account, as well as others regarding e.g. the size of the pump. In the illustrated embodiment, the diameter of the stem is about 3 mm, and the length of the entire regulator is about 55 mm. In the illustrated embodiment, the stem 210 has a constant diameter.

The Guide Member

Next to the inner valve 230, on the outer side thereof, a guide member 260 is arranged. The guide member 260 extends transversely so as to restrict the bending movement of the stem 210 and generally confine the bending to the portion of the stem 210 extending outside of the guide member 260. As such, the guide member 260 is advantageous to ensure that the function of the inner valve 230 is not affected by the bending motion of the stem 210. The guide member 260 may advantageously extend along the circumference of the stem 210 so as to symmetrically restrict the movement of the stem. In the illustrated embodiment, the guide member 260 is formed by four guide bars 262 being arranged so as to form a cross with the stem 210 in its centre.

The Inner Valve

The inner valve 230 comprises a valve member, extending circumferentially from the stem 210. The width of the valve member is generally constant from the position at which the valve member extends from the stem 210 and to its outer end. In the illustrated embodiment, the shape of the valve member may be described as generally forming the shape of a parabola. However, as may be gleaned from the enlargement B, the valve member does not follow the parabolic contour exactly. Rather, the valve member forms a number of straighter portions, which when seen as a whole may generally be deemed to follow the contour of a parabola.

The inner surface of the valve member is connected to a brace member 234. The brace member 234 is more rigid than the valve member and functions to restrict the movement of the valve member. Advantageously, the brace member 234 is attached to the upper surface of the valve member at a number of attachment locations. At these locations, the brace member 234 rigidly connects the valve member with the stem 210. Hence, the valve member is fixed at the attachment locations, and inhibited from moving outwardly or inwardly at these locations.

By inhibiting inward motion, the brace member 234 ensures that the valve member cannot be wrung in the wrong direction, i.e. in a direction opposite to the dispensing direction, even if the pressure in the chamber 110 should be higher than the pressure in the container 400 to which the pump is connected. This feature is particularly useful when the pump is used to empty a collapsible container 400. In a collapsible container 400, and in particular for the type of collapsible container 400 being semi-rigid, a negative pressure may be created in the container as liquid is drawn out of it via the pump. Hence, when the pump is in a closed position and the chamber 110 is full with liquid to be dispensed at the next dispensing cycle, the pressure in the chamber 110 may be larger than the pressure in the container 400. Moreover, the pressure gradient between the chamber 110 and the container 400 may be relatively large. The brace member 234 contributes to the inner valve 230 being a strong one-way valve which may withstand relatively large pressure gradients in a direction opposite to the dispensing direction without opening.

By inhibiting outward motion, the brace member 234 contributes to controlling the opening of the inner valve 230.

In the illustrated embodiment, the brace member 234 comprises four wings extending from the stem 210 and forming a cross with the stem 210 in the middle. The wings are connected to the valve member at attachment locations along the outer side of the wings.

It is understood that the brace member 234 should not inhibit movement of the entire valve member. Some portions of the valve member must remain movable in order to be able to open and close. This may be ensured by the attachment locations between the brace member 234 and the valve member being restricted to an inner area of the valve member, leaving a rim 232 without any attachment to the brace member 234 and extending along the circumference of the valve member. Alternatively, or in combination with the rim 232, portions of the valve member extending between spaced attachment locations of the brace member 234 may be movable so as to open and close the valve. However, in particular for use with a collapsible container in which a negative pressure may be created as described above, it is preferred that a rim 232 is provided, such that the capacity of the brace members 234 of inhibiting backward opening of the inner valve 230 need not be traded off in order to ensure opening of the valve in the correct direction.

In the illustrated embodiment, there is a rim 232 without connection to the brace member 234, which extends along the circumference of the valve member. The shape of this rim 232 is believed to be of more importance to the sealing function of the valve, than the shape of the inner portions of the valve, which are nevertheless substantially hindered from moving by means of the brace member 234.

The rim 232 will contact the housing 100 when in a closed position, and will be movable away from the housing 100 to an open position. As may be gleaned from FIG. 5*b*, the rim 232 may advantageously cooperate with a shoulder 119 formed in the chamber wall. Hence, backward opening of the valve 230 at the rim 232 is inhibited by the presence of the shoulder 119.

The rim 232 forms an angle $\alpha$ with the longitudinal centre of the regulator 200 (i.e. with the stem 210). It is preferred that the angle $\alpha$ is in the range 15-30 degrees, more preferred 20-30 degrees, most preferred 20-25 degrees. In the illustrated embodiment, the angle $\alpha$ is about 23 degrees.

The thickness of the rim 232 should be selected depending on the resilient plastic material, such that the flexibility of the rim 232 allows for opening and closing of the inner valve. It is believed to be advantageous in view of resiliency if the thickness of the rim 232 is substantially constant throughout the rim 232. Preferably, the thickness may be between 0.2 and 0.4 mm. In the illustrated embodiment, the thickness of the rim is about 0.3 mm.

In view of the above, it is envisaged that the inner valve member as a whole could be formed in other general shapes than the parabolic shape. For example, the inner valve member could have a generally conical shape. Generally, the shape of the portions being inhibited from motion by the brace member 234 may be freely selected, as these will not be movable. However, it is believed to be advantageous that the rim 232 of the valve member have properties as described above.

Generally, it will be understood that the inner valve 230 may contribute to the tightness of the entire system consisting of a collapsible container in liquid tight connection to the pump. The inner valve 230 should be a resistant one-way valve, opening only in the dispensing direction and at an inner valve opening pressure. As a negative pressure is created in the container, only a greater negative pressure in the chamber may cause the inner valve to open. Negative pressure in the chamber is only created right after dispensing of liquid, when the chamber 110 is to be refilled. In all other situations, in particular in the situation when the pump is not in use but the chamber shall be closed and full with liquid, there is negative pressure in the bottle and a higher pressure in the chamber. Hence, the inner valve 230 will securely seal the container from the chamber. This means that, in this situation, the outer valve 220 need only ensure that the content of the chamber does not leak—i.e. the outer valve 220 need not carry any weight from the content of the container.

It is understood that the inner valve 230, when positioned in the chamber 110, is circumferentially compressed. Hence, in a relaxed, uncompressed state, the inner valve 230 has an outer diameter being greater than the diameter of the chamber 110 at the location of the inner valve 230. As may be gleaned from FIG. 5*b*, in the illustrated embodiment, the inner valve 230 will be located in the upper portion of the middle compartment 114 of the housing.

Advantageously, the difference between the inner diameter of the chamber at the location of the inner valve 230, and the outer diameter of the inner valve 230 when in an uncompressed state is between 0.20 and 0.35 mm, preferably between 0.25 and 0.35 mm, most preferred between 0.25 and 0.30 mm.

In the illustrated embodiment, the difference between the inner diameter of the chamber at the location of the inner valve 230, and the outer diameter of the inner valve 230 when in an uncompressed state is about 0.3 mm.

The Fixation Plate

The regulator 200 is moreover provided with fixation means for attaching the regulator 200 in the housing 100. In the illustrated embodiment, the fixation means comprises a fixation plate 250 arranged at the stem 210. Advantageously, the fixation plate 250 is provided as illustrated at the innermost end of the stem 210. The fixation plate 250 is a circular plate which is to be inserted in a corresponding ridge at the innermost portion of the housing 100. The plate 250 is provided with flow openings 252 for allowing flow of liquid from the container 400 to the pump. The size and shape of the flow openings 252 may be selected so as to control the size of the flow from the container 400 into the pump. For example, the flow openings 252 may be formed as cutouts extending from the edge of the fixation plate 250 towards the centre thereof.

In the illustrated embodiment, there are three circular flow openings 252 in the fixation plate 250. If the pump is to be used for pumping liquids with relatively high viscosities, it is believed to be advantageous to provide bigger area flow openings 252 than those of the illustrated embodiment. For high viscosity liquids, two relatively large cutouts may be formed opposite to one another. By regulating the size of the cutouts, the flow of liquid may be regulated. For example, the two cutouts may take up almost half the surface of the fixation plate 250, each cutout forming approximately a quarter of a circle.

The Housing

Figure 3A:
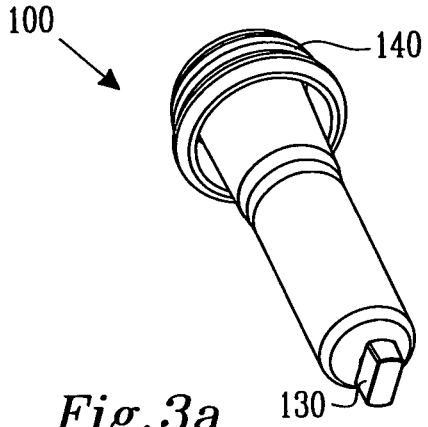
FIGS. 3*a* to 3*c* illustrate a housing of the embodiment of FIG. 1
Figure 3B:
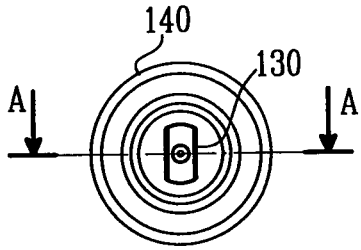
Figure 3C:
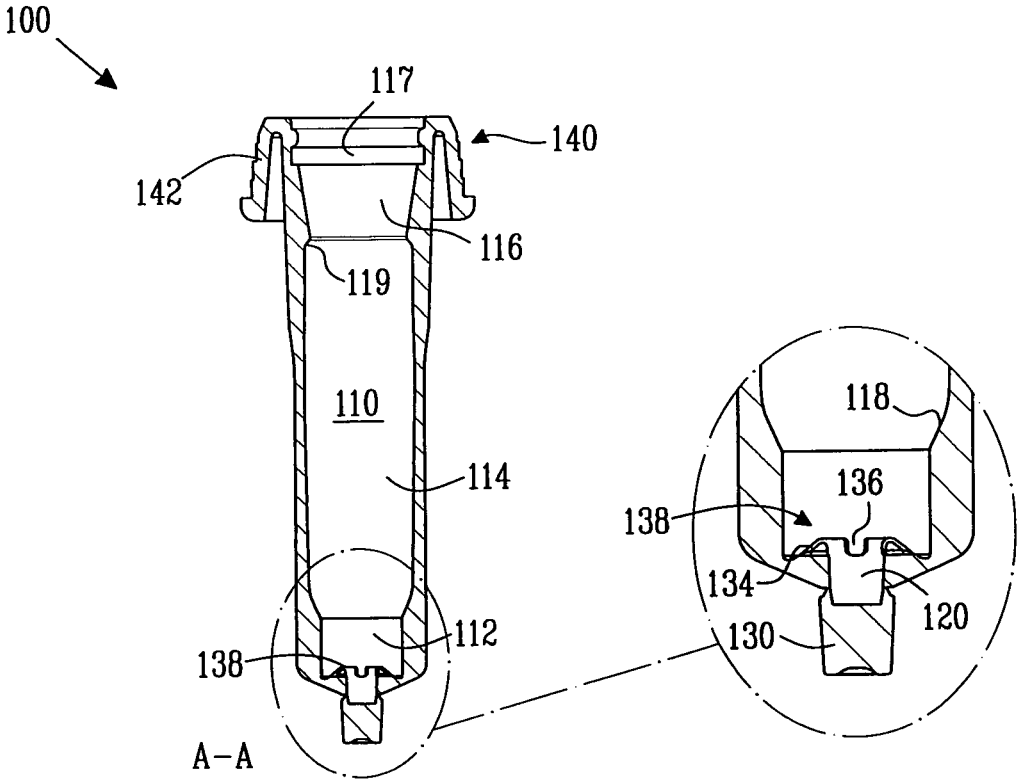

FIGS. 3*a* to 3*c* illustrate the housing of the exemplary embodiment. FIG. 3*a* is a perspective view of the housing, FIG. 3*b* is a cross-sectional view of the housing, and FIG. 3*c* is view of the regulator as seen from the outermost end.

The housing 100 is generally cylindrical, extending from an innermost portion being provided with a connector 140 for connection to a container, to an outermost portion including the dispensing opening 120.

The Closure

As seen in FIGS. 3*a* to 3*b*, the housing 100 may initially be provided with a closure 130 for sealing the dispensing opening 120. The closure 130 is to be removed when the pump is set in operation. The closure 130 will ensure the integrity of the pump during e.g. transport and storage, so that no debris or contaminants will accidentally come into the housing 100 via the dispensing opening 120. In the illustrated embodiment, the closure 130 is formed in integrity with the housing 100. The closure 130 comprises a head which is connected to the housing surrounding the dispensing opening 120 via a weakening line 132. The thickness of the housing material is reduced along the weakening line, such that the closure 130 may be removed by pulling or twisting the head, causing the weakening line 132 to rupture.

In view of manufacturing as well as security considerations, it is highly advantageous to form the closure 130 in integrity with the housing, an example of which is shown in the illustrated embodiment. However, naturally other, less advantageous closures are conceivable, such as a closing tape or a separate closing plug.

The Outer Compartment

The outermost portion of the housing forms an outer compartment 112. As may be gleaned from FIG. 5*b*, the outer valve 220 will be confined in the outer compartment 112 in the assembled pump.

Hence, the inner diameter of the outer compartment 112 and the outer diameter of the outer valve 220 should be adapted so as to provide the desired sealing effect. To that end, the outer diameter of the outer valve 220 is generally made slightly larger than the inner diameter of the outer compartment 112, such that the outer valve 220 is slightly compressed when in place in the outer compartment, causing the inner wall of the outer compartment 112 to press on outer valve 220. The difference in size between the outer compartment 112 and the outer valve 220 may be selected with consideration to the resiliency and flexibility of the outer valve 220 so as to achieve a sufficiently strong seal of the outer valve 220. However, it is to be understood that the size difference referred to in this context is not large, perhaps in the range of 1-2%, which in the illustrated embodiment corresponds to 0.15 mm.

When the housing is formed from resilient material, as in the illustrated embodiment, it is generally desired that the shape of the housing at the outer compartment 112 is relatively stable, as otherwise the function of the outer valve 220 to be contained therein might be impaired. Hence, in the illustrated embodiment, the thickness of the housing walls surrounding the outer compartment 112 is relatively large.

The Flow Control Means

The end portion of the outer compartment 112, in which the dispensing opening 120 is provided, comprises flow control means 138. The flow control means 138 are provided for ensuring proper function of the pump 1 also when pumping liquids having relatively high viscosity.

As have been briefly mentioned previously, high viscosity liquids will put specific requirements on the pump. As the stem 210 is resilient, it may distort not only in a sideway direction as when bending, but it may also elongate. This is what may happen when the pump is used for pumping high viscosity liquids. The pressure from a high viscosity liquid may, when the outer valve 220 is in its closed symmetrical position in the outer compartment 112, cause the stem 210 to elongate such that the outer valve 220 is pushed outwardly towards the end of the housing 100, while still in a symmetrical position in the housing. If no flow control means 138 were provided, the outer valve 220 would risk contacting the bottom of the outer compartment 112 with the dispensing opening 120, a situation which might impair the function of the outer valve 220.

To ensure the function of the outer valve 220 when the stem 210 is in an outstretched position, the flow control means 138 are provided to remove the outer valve 220 from contact with the dispensing opening 120 and the end wall of the housing 100. Hence, the flow control means 138 generally consists of spacing structures, which are distributed around the dispensing opening 120, and which form a stop for the outer valve 220.

In the illustrated embodiment, the flow control means 138 comprises a circular ridge 134 surrounding the dispensing opening 120. A plurality of grooves 136 are arranged in the ridge 134 to ensure flow of liquid through the dispensing opening 120 when the outer valve 220 contacts the ridge 134. In this specific embodiment, there are four grooves extending from the dispensing opening 120 through the ridge 234 and forming a cross with the dispensing opening in its centre. As has been mentioned previously, the outer valve 220 of the illustrated embodiment comprises a central knob 224. When the outer valve 220 is in contact with the ridge 134, it is the knob 224 that will rest on the ridge 134. The rim 222 of the outer valve 220 may extend around the ridge 134 such that its sealing function is not affected by the contact with the flow control means 138. From this position, the outer valve 220 may be tilted and open to dispense liquid as has been described previously. Passage of liquid via the dispensing opening will take place via the grooves 136 in the ridge 134. Also any suck-back of liquid may take place via the grooves 136.

In view of the above, it is understood that flow control means 138 may be provided at the end of the outer compartment 112 for cooperation with some central abutment means 224 of the outer valve, such that, if the regulator 200 is stretched such as when high viscosity liquid is pumped, the central abutment means may contact the flow control means while ensuring function of the outer valve 220. This may be achieved by a knob 224 of the outer valve 220 contacting the flow control means while allowing the rim 222 of the outer valve 220 to extend around the flow control means such that its function is not impaired.

When the regulator 200 is in an outstretched position, the spacer 240 may advance such that it at least partly enters into the outer compartment 112. As may be envisaged from FIG. 5*b*, also the spacer 240 may be formed to restrict the elongation of the regulator 200, by being provided with expanding structures that could not enter into the outer compartment 112. The indentations 242 on the spacer 240 becomes useful for facilitating passage of liquid past the spacer 240, if the spacer is at least partly introduced into the relatively narrow outer compartment 112.

The Slope

At the innermost end of the outer compartment 112, the inner diameter of the housing 100 widens to a middle compartment 114. The middle compartment 114 will generally contain a volume of liquid to be dispensed. Hence, the size of the middle compartment 114 should be selected in accordance with a desired maximum volume to be dispensed.

In the illustrated embodiment, the inner diameter of the middle compartment 114 is wider than the inner diameter of the outer compartment. The diameter does not widen abruptly, but is gradually increased along part of the length of the housing so as to form a slope 118. The slope 118 is useful in that it promotes the flow of liquid through the housing 100. Moreover, the slope 118 may be contacted by the spacer 240 of the regulator 200, to control the bending of the regulator 200. By adjusting the contour of the slope 118 and the contour of the spacer 240, the bending of the regulator may be controlled, in particular, as mentioned above, such that the tilting of the outer valve 220 is restricted.

The Shoulder

At the innermost end of the middle compartment, the inner wall of the housing 100 forms a shoulder 119 for forming the valve seat of the inner valve 230. Hence the inner diameter of the housing 100 narrows to form a seat against which the inner valve 230 may abut in a direction opposite to the dispensing direction. The size and shape of the shoulder should be adapted to the inner valve 230 so as to form a reliable one-way valve as described previously.

In particular, when the inner valve 230 comprises a brace member 234 and a rim 232, it is understood that the shoulder 119 should be formed so as to form an abutment for the rim 232. Hence the brace member 234 and the shoulder 119 may be said to be complementary, both inhibiting opening of the inner valve 230 in the wrong direction.

It is understood, that without the brace member 234, and in particular if a relatively flexible inner valve 230 is used, there could be a risk that the inner valve 230 deforms such that the rim 232 slides off the shoulder 119 and the inner valve 230 opens in the direction opposite to the dispensing direction. Hence, the brace member 234 is particularly useful when dealing with relatively flexible valves.

The Inner Compartment

Inside of the shoulder 119, the housing 100 forms an inner compartment 116. The inner compartment 116 will house the brace member 234 and the fixation between the regulator 200 and the housing 100. In the illustrated embodiment, the fixation plate 250 of the regulator is fastened in a corresponding fixation groove 117 in the inner wall of the inner compartment 116.

The Housing Wall

Generally, the thickness of the wall of the housing is relevant to ensure the required resilience of the chamber 110. It is understood, that in the illustrated embodiment, the chamber 110 is substantially formed by the middle compartment 114 of the housing 100. Hence, the thickness of the wall of the housing is relatively thin at the middle compartment 114 for enabling compression of the chamber 110. The thickness of the wall of the housing at the outer compartment 112 and the inner compartment 116 is relatively thick, such that the shape of the housing is kept more constant at these compartments 112, 116. This ensures proper function of the inner and outer valve 230, 220.

The Collar

The innermost end of the housing 100 is provided with a connection member for connection, direct or via some additional connecting means, to a container. In the illustrated embodiment, the connection member comprises a collar 140 which is to be connected to the container 400 via a separate connector 300. The collar 140 extends from the innermost portion of the inner compartment 116 of the housing 100, and back towards the outer end of the housing 100. The collar 140 is in this embodiment generally conical extending outwardly from the innermost end.

The outer surface of the collar 140 may advantageously be provided with dents 142. In the described embodiment the dents 142 form a stair-shape on the conical collar 140.

The Connector

Figure 4A:
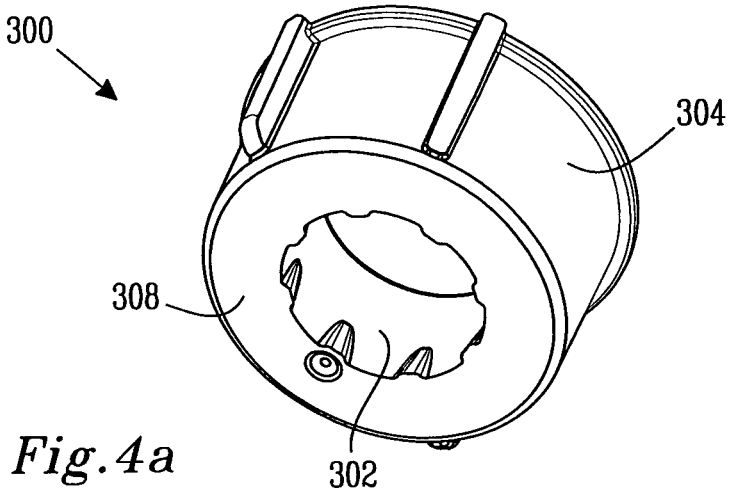
FIGS. 4*a* to 4*c* illustrate an embodiment of a connector for use with the pump of FIG. 1
Figure 4B:
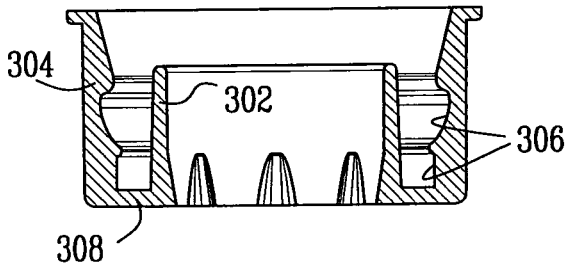
Figure 4C:
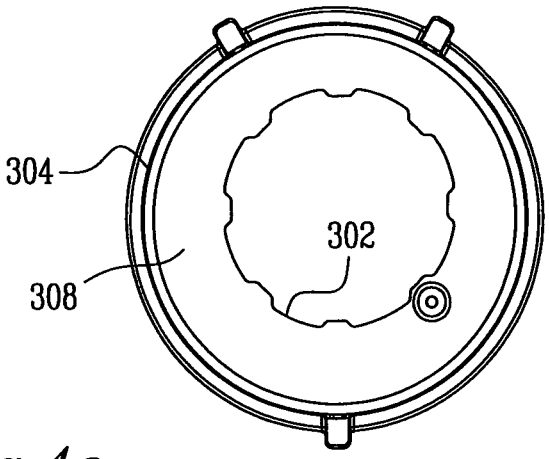

FIGS. 4*a* to 4*c* illustrate an embodiment of a connector for connecting the pump of the exemplary embodiment to a container. FIG. 4*a* is a perspective view of the connector, FIG. 4*b* is a cross-sectional view of the connector, and FIG. 4*c* is a top view of the connector.

The connector 300 comprises a generally ring-shaped base portion 308, forming an opening in which the pump will be arranged. An inner flange 302 extends from the inner periphery of the base portion 308, and an outer flange 304 extends from the outer periphery of the base portion 308. The outer flange 304 is provided with two circumferentially extending indentations 306 on the side facing the inner flange 302.

The indentation 306 closest to the base portion 308 is intended to snap fit with the outermost portion of the collar 140 of the housing for connecting the pump to the connector 300. The other indentation 306 is intended to snap fit with a portion of the container 400 as will be described later.

Generally, it is believed to be advantageous having a connector 300 being provided for snap fit devices for enabling snap-fit connection with the pump and with the container. Moreover, it is believed that other embodiments of connectors providing such snap-fits than the one described are conceivable. In particular, the shape, size and location of the snap-fit mechanisms may be varied, as may of course the design of the connecting structures of the housing and the container.

Assembly of Pump and Collar

Advantageously, the pump is formed as in the illustrated embodiment, of two parts only. Preferably, one part forms the regulator 200 and the other forms the housing 100. Hence, the pump may be easily assembled by introducing the regulator 200 into the housing 100 such that a fixation member 250 of the regulator may snap fit into a locking device in the housing 100. Hence, assembly of the pump is particularly easy and reliable. In the illustrated embodiment, the fixation member consists of a locking plate 250 which is snap fit into a locking device being a fixation groove 117.

It is understood that the two parts are preferably formed from resilient plastic material. Thus, the resilient properties of the materials are useful also when forming the snap fit of the regulator 200 in the housing 100. However, for providing a reliable interlocking, it is understood that the snap fit must be relatively stable. The required stability may easily be provided by adapting the design and the thickness of the material, e.g. the thickness of the fixation plate 250 in the illustrated embodiment.

Moreover, when used with a connector 300 as described above, the assembled pump is easily connected to the connector by introducing the housing through the ring opening of the connector 300, and providing a snap-fit interlock between the housing 100 and the connector 300. Hence, advantageously there is a first snap fit between the regulator 200 and the housing 100, and a second snap fit between the housing and the connector 300.

In the illustrated embodiment, the second snap fit is achieved by an utmost dent 142 of the collar 140 of the housing 100 forming a snap-lock when received in the innermost indentation 306 in the outer flange 304 of the connector 300. The collar 140 is hence received between the inner flange 302 and the outer flange 304 of the connector.

Figure 5A:
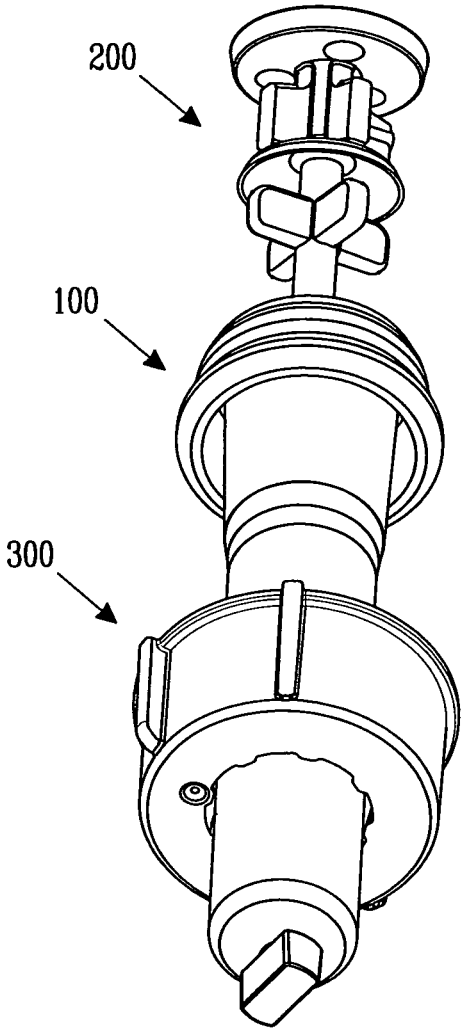
FIGS. 5*a* and 5*b* illustrate the assembly of the regulator of FIGS. 2*a* to 2*c*, the housing of FIGS. 3*a* to 3*c*, and the connector of FIGS. 4*a* to 4*c*.

FIG. 5*a* illustrates how the connector 300, housing 100 and regulator 200 may be introduced into one another for forming a connector-pump assembly.

Figure 5B:
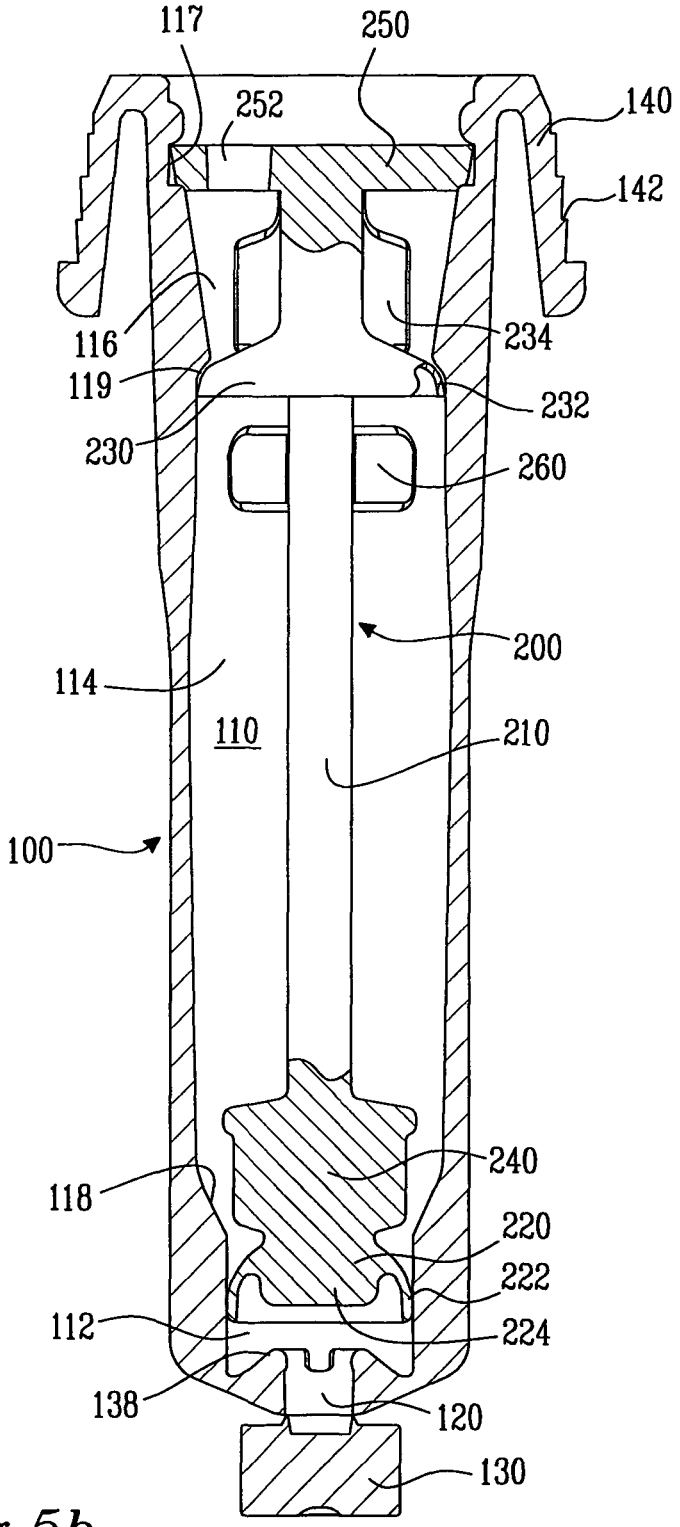

FIG. 5*b* is a cross-sectional view of the connector-pump assembly, and shows how the detailed features as described above come together in the illustrated embodiment.

The outer valve 220 resides in the outer compartment 112 of the housing 100, with its rim 222 in contact with the chamber wall. In FIG. 5*b*, the stem 210 is relaxed, as when the pump is empty or when it is used for pumping liquids with relatively low viscosity. It is understood that if the stem 210 is stretched when pumping liquids of relatively high viscosity, the knob 224 of the outer valve 220 could contact the flow control means 138 surrounding the dispensing opening 120.

The spacer 240 is positioned adjacent to the slope 118 of the chamber wall, and it is understood that when the stem 210 is bent to tilt the outer valve 220, the spacer 240 would restrict the bending movement by coming into contact with the slope 118 and/or with other portions of the inner wall of the housing 100.

The middle compartment 114 of the housing 100 extends along a selected length and surrounding the stem 210. It is understood that the middle compartment 114 contributes to the volume to be pumped and provides space for the bending of the stem 210. Moreover, the middle compartment 114 is essentially the portion of the chamber which will be compressed when pumping, which is why the size of the middle compartment is also relevant for the suction force of the pump. As mentioned previously, the thickness of the walls of the middle compartment may be selected so as to provide a resiliency being suitable for the pumping function.

However, at the inner portion of the middle compartment 114 the thickness of the walls is already increased, in order to stiffen the structure of the pump before reaching the inner valve 230. (It may be noted that the thickness of the housing walls is relatively thick surrounding the inner valve 230 and the outer valve 220, but relatively thin to form a pumping section between them.) The relatively thick-walled portion of the middle compartment 114 surrounds the guide member 260 provided on the stem 210, which is likewise a structure for restricting the movements of the inner valve 230.

The inner valve 230 is seen in place with its rim 232 contacting the shoulder 119 of the housing 100. The brace member 234 acting to control the inner valve 230 is surrounded by the inner compartment 116 of the housing.

Finally, the fixation member 250 is in place in the fixation groove 117 of the housing 100, securing the regulator 200 in the housing 100.

It is understood that the illustrated embodiment of a pump formed by a housing 100 and a regulator 200 may be used with other connectors than the embodiment described herein. To that end, the housing 100 may naturally be provided with other connection means 140 than those described herein.

However, the illustrated connector is believed to be particularly advantageous due to its easy assembly and reliable liquid tight connection. In this embodiment, the collar 140 is snap-fit into the connector 300 as described previously. When the collar 140 is in place in the connector 300, it is seen that a space is formed between the collar 140 and the innermost indentation 306 of the connector 300. It is understood, that a designated container may be received in this space, and snap-fit to lock using the innermost indentation 306 of the connector 300. The dents 142 on the collar 140 will hence function to increase the friction and the stability of the snap-fit.

The System

Figure 6A:
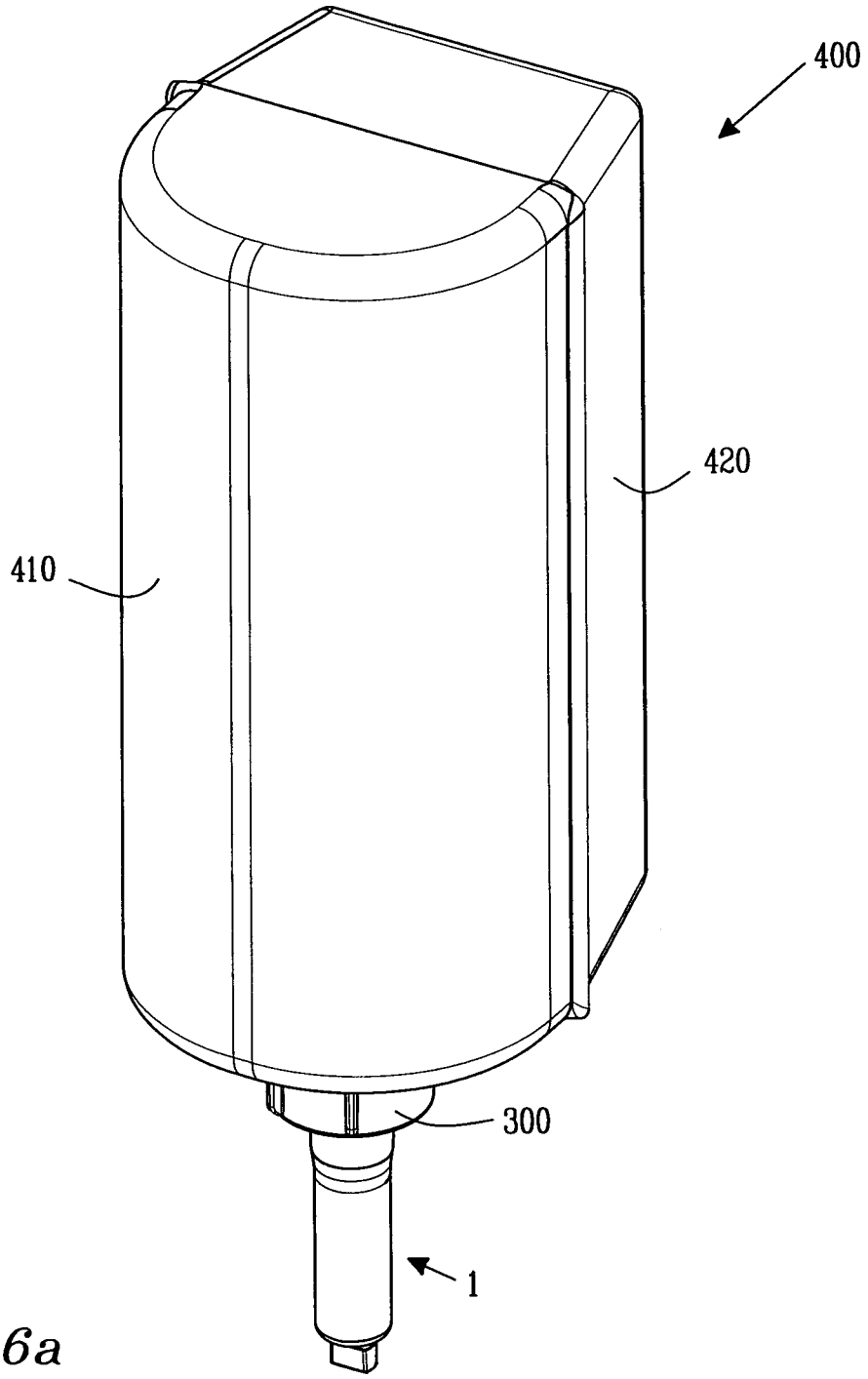
FIGS. 6*a* to 6*c* illustrate a system comprising a collapsible container, and the assembly of FIGS. 5*a* to 5*b*.
Figure 6B:
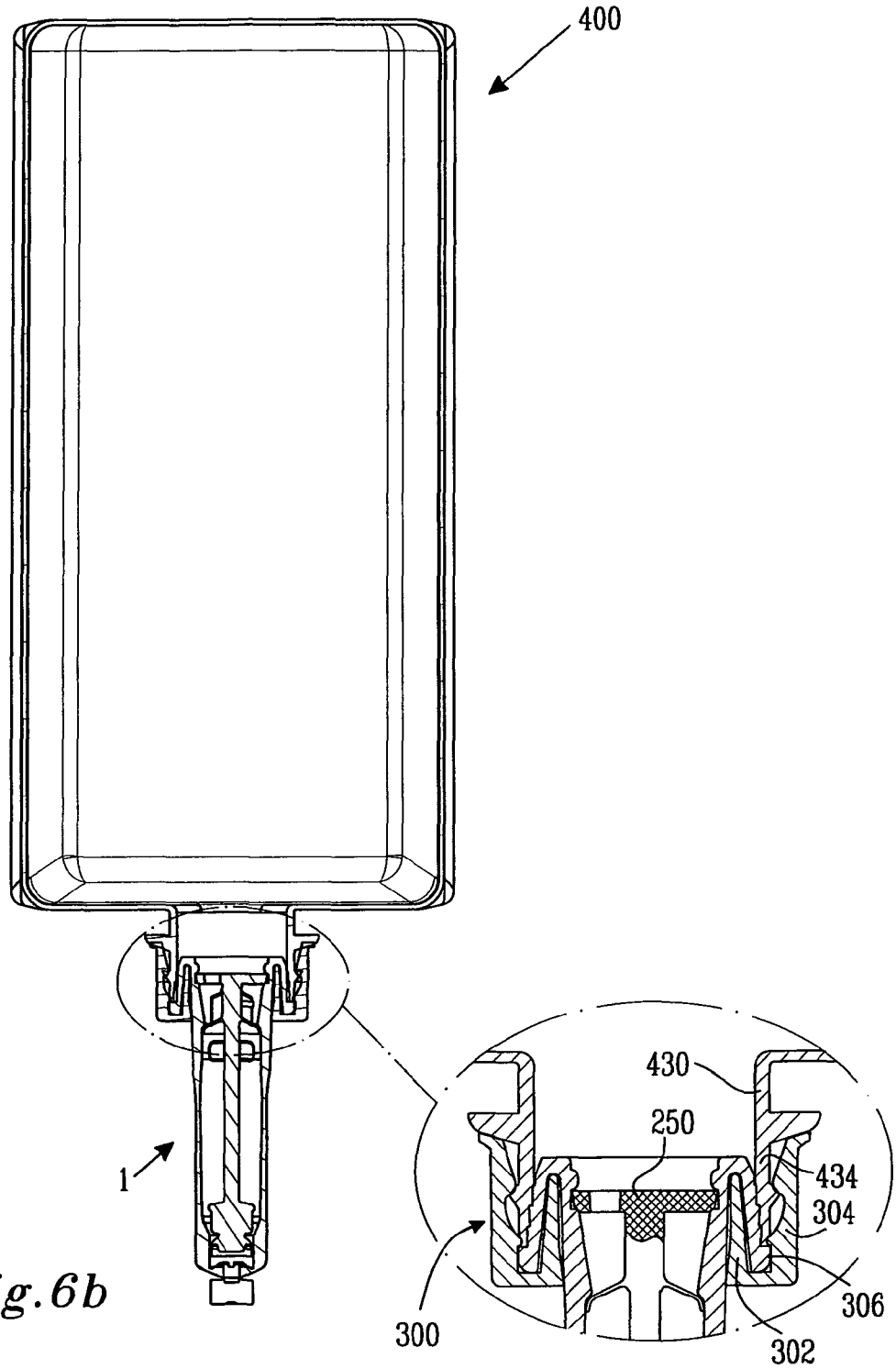
Figure 6C:
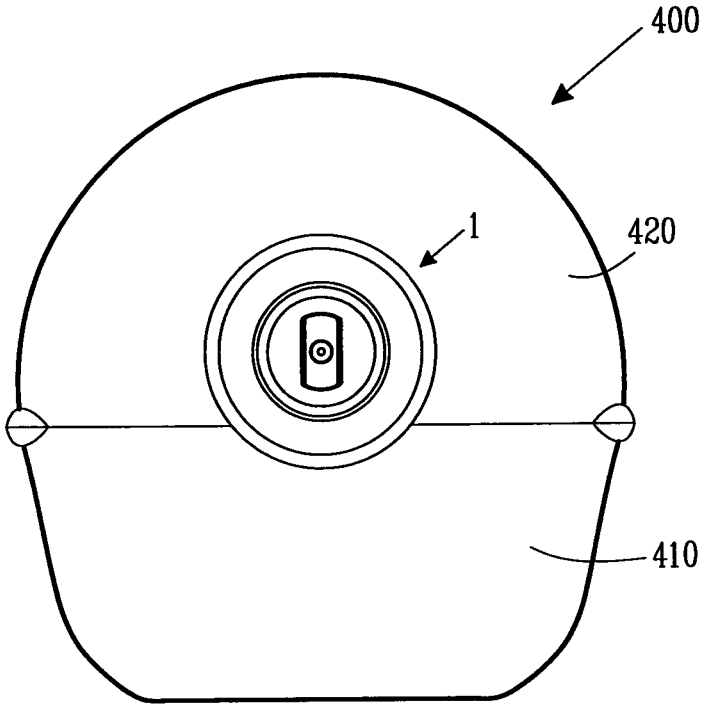

FIGS. 6*a* to 6*c* illustrate an embodiment of a dispensing system comprising a collapsible container, a pump and a connector as described above. FIG. 6*a* is a perspective view of the dispensing system, FIG. 6*b* is a cross-sectional view of the dispensing system, and FIG. 6*c* is a bottom view of the dispensing system.

The collapsible container 400 is advantageously of the semi-rigid type, having a relatively rigid portion 410 and a collapsing portion 420. Generally, the difference in rigidity of the portions may be obtained by providing the portions with walls having different material thicknesses, the rigid portion 410 having a larger wall thickness than the collapsing portion 420.

The illustrated container 400 is believed to be particularly advantageous, having only one rigid portion 410 and one collapsing portion 420. The collapsing portion 420 may collapse into the rigid portion during emptying of the bottle. During collapse, the rigid portion 410 will provide sufficient support for maintaining a controlled position of the container 400 in e.g a dispenser. This is particularly advantageous when information is to be printed on the container, and it is desired that said information shall be visible through e.g. a window in the dispenser throughout the emptying process.

The illustrated container 400 is divided longitudinally, such that the rigid portion 410 approximately forms one longitudinal half of the container 400, and the collapsing portion 420 approximately forms the other longitudinal half. An outlet 430 is formed as extending from an end wall of the rigid portion 410. The outlet 430 forming part of the rigid portion 410 is advantageous from a manufacturing point of view and ensures that the position and structure of the outlet 430 is stable.

From FIG. 6*c* it may be gleaned how the pump 1 is arranged to the outlet 430 on the rigid portion 410 of the container. Moreover, it is seen that the rigid portion 410 in this case form a substantially regular cylindrical longitudinal outer wall, whereas the collapsible portion form a slightly expanded structure having a more irregular shape forming two bulbs or gentle corners.

In FIG. 6*b* the connection between the collapsible container 400 and the pump 1 via the connector 300 is illustrated, with particular reference to the enlargement. The connection between the pump 1 and the connector 300 has been described above. The container 400 is provided with a connection piece 432 at its outlet 430. The connection piece 432 is formed to be received in the open space formed between the collar 140 of the pump and the outer flange 304 of the connector 300. For accomplishing a snap-fit lock between the connector 300 and the container 400, the connection piece 432 is provided with a rib 434 to interlock with the innermost indentation 306 of the connector 300. The strength of the interconnection of the parts is increased by the dents 142 of the collar 140 which will contact the inside of the connection piece 432 of the container 400 and increase the friction against disassembly of the parts.

It is understood, that due to the snap fit connection of all of the components, the assembly of the entire system is particularly easy. Nevertheless, the connection is fluid-tight and reliable, ensuring that no air or contaminants are introduced into the system, and that the system does not leak.

Manufacture and Materials

The regulator and the housing may advantageously be formed from polypropene-based materials. The materials should be selected so as to provide sufficient resiliency for the desired functions. For the functions being dependent on the ability of the material to resume its original shape after distortion, it is believed that the parts should be able to resume its shape after at least 1000 distortions, in order for the function to be guaranteed until a container is emptied. This number is of course dependent on the size of the container, and is to be seen as an approximation only. Pumps have been manufactured where the parts withstand at least 10 000 distortions, which is well over the estimated requirements.

The regulator and the housing may advantageously be formed from low density materials.

Moreover, the materials in the pump should be selected such that they may withstand the liquid to be pumped, that is without being dissolved thereby.

Preferably, the material or materials in the pump shall be of the same type such that the pump is recyclable as a single unit, without previous disassembly.

Advantageously, the regulator and the housing may be injection-moulded.

The container may advantageously be formed from a polypropylene-based material or a HDPE material. It is particularly advantageous if the container is formed from a material of the same type as the materials in the pump, such that the entire dispensing system may be disposed and recycled as one single unit.

The container may advantageously be blow-moulded.

It is readily understood that numerous alternative embodiments may be envisaged, incorporating one or more of the above-mentioned advantageous features.

The invention claimed is:

1. A disposable pump for a liquid dispensing system comprising a compressible container, the pump comprising:

a housing forming a chamber and a dispensing opening, wherein the pressure in the chamber is varied for pumping liquid from the compressible container to the chamber, and further from the compressible chamber to the dispensing opening;

an inner valve enclosed by the housing, the inner valve being configured for regulating a flow of liquid between the container and the chamber; and an outer valve enclosed by the housing, the outer valve being configured for regulating a flow of liquid between the chamber and the dispensing opening, wherein the pump assumes a closed position, in which a volume of liquid is drawn from the container to the chamber by a negative pressure created in the chamber and the outer valve, and a dispensing position, in which a volume of liquid is drawn from the chamber to the dispensing opening, wherein the inner valve opens for a flow of liquid in the dispensing direction at an inner valve opening pressure acting in the dispensing direction and closes for any pressure acting in a direction opposite to the dispensing direction, the outer valve opens for a flow of liquid in the dispensing direction at an outer valve opening pressure, said inner valve and said outer valve being arranged on a regulator which is fixedly arranged in the housing, wherein the regulator comprises a stem extending in a straight, single longitudinal extension between the inner valve and the outer valve such that, as the pump transfers from the dispensing position to the closed position, and a negative pressure is created in the chamber, a pressure difference between the container and the chamber will cause the inner valve to open so as to allow liquid to pass from the container to the chamber, and a pressure difference between the dispensing opening and the chamber will cause the outer valve to remain open to allow liquid to be sucked back in the direction opposite the dispensing direction from the dispensing opening to the chamber, and wherein when the pump is in the dispensing position, the outer valve assumes a tilted position in the chamber, and when the pump is in the closed position, the outer valve assumes a symmetrical position in the chamber, a center of the outer valve being closer to a wall of the chamber when the outer valve is in the tilted position relative to when the outer valve is in the symmetrical position.

2. The pump according to claim 1, wherein, as the pump transfers from the dispensing position to the closed position, the outer valve will remain open to allow liquid or air to be sucked back from the dispensing opening to the chamber, and then, as the closed position is reached, seal between the chamber and the dispensing opening.

3. The pump according to claim 1, wherein the inner valve opening pressure is less than the outer valve opening pressure, such that the outer valve will close before the inner valve as the negative pressure in the chamber is leveled out.

4. The pump according to claim 1, wherein the inner valve, when in a closed position, has a contact area with the housing which is greater than the contact area of the outer valve with the housing, when in a closed position.

5. The pump according to claim 1, wherein the outer valve, when in a closed position in the chamber, is circumferentially compressed in relation to an uncompressed state of the outer valve, and a difference between a diameter of the chamber at a location being in contact with the outer valve when in the closed position, and a diameter of the outer valve when in the uncompressed state, is between 0.09 and 0.20 mm.

6. The pump according to claim 5, wherein the outer valve, when in the closed position in the chamber, is circumferentially compressed in relation to the uncompressed state of the outer valve, and the difference between the diameter of the chamber at the location being in contact with the outer valve when in the closed position, and the diameter of the outer valve when in the uncompressed state, is between 0.10 and 0.20 mm.

7. The pump according to claim 6, wherein the outer valve, when in the closed position in the chamber, is circumferentially compressed in relation to the uncompressed state of the outer valve, and the difference between the diameter of the chamber at the location being in contact with the outer valve when in the closed position, and the diameter of the outer valve when in the uncompressed state, is between 0.10 and 0.15 mm.

8. The pump according to claim 1, wherein the inner valve, when in a closed position in the chamber, is circumferentially compressed in relation to an uncompressed state of the inner valve and a difference between a diameter of the chamber at a location circumferentially compressing the inner valve and a diameter of the inner valve when in said uncompressed state is between 0.20 and 0.35 mm circumferential direction.

9. The pump according to claim 8, wherein the inner valve, when in the closed position in the chamber, is circumferentially compressed in relation to the uncompressed state of the inner valve and the difference between the diameter of the chamber at the location circumferentially compressing the inner valve and the diameter of the inner valve when in said uncompressed state is between 0.25 and 0.35 mm circumferential direction.

10. The pump according to claim 9, wherein the inner valve, when in the closed position in the chamber, is circumferentially compressed in relation to the uncompressed state of the inner valve and the difference between the diameter of the chamber at the location circumferentially compressing the inner valve and the diameter of the inner valve when in said uncompressed state is between 0.25 and 0.30 mm circumferential direction.

11. The pump according to claim 1, wherein the inner valve is substantially parabolic.

12. The pump according to claim 1, wherein the inner valve comprises a rim which is movable to and from sealing contact with the housing, said rim forming an angle $\alpha$ with the longitudinal axis of the pump, wherein the angle $\alpha$ is in the range 15-30 degrees.

13. The pump according to claim 1, wherein the outer valve has an outer shape at least partly following a contour of a sphere.

14. The pump according to claim 13, wherein the outer shape of the outer valve follows the contour of the sphere for forming at least half the sphere.

15. The pump according to claim 1, wherein the outer valve comprises a rim which is movable to and from a sealing contact with the housing, and said rim, when the pump is in the closed position, is confined between parallel housing walls and extending in parallel to said walls.

16. The pump according to claim 1, wherein a guide member extends along a circumference of the stem so as to symmetrically restrict movement of the stem.

17. The pump according to claim 16, wherein the guide member is formed from four bars arranged so as to form a cross with the stem at a center of the cross.

18. The pump according to claim 1, wherein a guide member is arranged on an outer side of the inner valve, the guide member extending transversely so as to confine bending of the stem to a portion of the stem extending outside the guide member.

19. The pump according to claim 18, wherein the guide member extends along a circumference of the stem so as to symmetrically restrict movement of the stem.

20. A disposable pump for a liquid dispensing system comprising a compressible container, the pump comprising:

a housing forming a chamber and a dispensing opening, wherein the pressure in the chamber is varied for pumping liquid from the compressible container to the chamber, and further from the compressible chamber to the dispensing opening;

an inner valve enclosed by the housing, the inner valve being configured for regulating a flow of liquid between the container and the chamber;

an outer valve enclosed by the housing, the outer valve being configured for regulating a flow of liquid between the chamber and the dispensing opening; and a stem defined by a straight, single longitudinal extension between the inner valve and the outer valve, the stem being resilient and bendable sideways during pumping so as to resume an original shape of the stem after bending, wherein the pump assumes a closed position, in which a volume of liquid is drawn from the container to the chamber by a negative pressure created in the chamber, and a dispensing position, in which a volume of liquid is drawn from the chamber to the dispensing opening, wherein the inner valve opens for a flow of liquid in the dispensing direction at an inner valve opening pressure acting in the dispensing direction and closes for any pressure acting in a direction opposite to the dispensing direction, the outer valve opens for a flow of liquid in the dispensing direction at an outer valve opening pressure, said inner valve and said outer valve being arranged on a regulator which is fixedly arranged in the housing, such that, as the pump transfers from the dispensing position to the closed position, and a negative pressure is created in the chamber, a pressure difference between the container and the chamber will cause the inner valve to open so as to allow liquid to pass from the container to the chamber, and a pressure difference between the dispensing opening and the chamber will cause the outer valve to remain open to allow liquid to be sucked hack in the direction opposite the dispensing direction from the dispensing opening to the chamber.

21. A disposable pump for a liquid dispensing system comprising a compressible container, the pump comprising:

a housing forming a chamber and a dispensing opening, wherein the pressure in the chamber is varied for pumping liquid from the compressible container to the chamber, and further from the compressible chamber to the dispensing opening;

an inner valve enclosed by the housing, the inner valve being configured for regulating a flow of liquid between the container and the chamber;

an outer valve enclosed by the housing, the outer valve being configured for regulating a flow of liquid between the chamber and the dispensing opening; and a stem extending between the inner valve and the outer valve, the stem being resilient and bendable sideways so as to resume an original shape of the stem after bending, wherein the pump assumes a closed position where the stem is straight, in which a volume of liquid is drawn from the container to the chamber by a negative pressure created in the chamber, and a dispensing position in which the stem is deformed sideways, in which a volume of liquid is drawn from the chamber to the dispensing opening, wherein the inner valve opens for a flow of liquid in the dispensing direction at an inner valve opening pressure acting in the dispensing direction and closes for any pressure acting in a direction opposite to the dispensing direction, the outer valve opens for a flow of liquid in the dispensing direction at an outer valve opening pressure, said inner valve and said outer valve being arranged on a regulator which is fixedly arranged in the housing, such that, as the pump transfers from the dispensing position to the closed position, and a negative pressure is created in the chamber, a pressure difference between the container and the chamber will cause the inner valve to open so as to allow liquid to pass from the container to the chamber, and a pressure difference between the dispensing opening and the chamber will cause the outer valve to remain open to allow liquid to be sucked back in the direction opposite the dispensing direction from the dispensing opening to the chamber.

* * * * *